US006289972B1

(12) United States Patent
Benedetti

(10) Patent No.: US 6,289,972 B1
(45) Date of Patent: Sep. 18, 2001

(54) INTEGRATED PLANT FOR THE PRODUCTION OF ROLLED STOCK

(75) Inventor: Gianpietro Benedetti, Campoformido (IT)

(73) Assignee: Danieli Technology Inc., Cranberry Township, PA (US)

( * ) Notice: Subject to any disclaimer, the term of this patent is extended or adjusted under 35 U.S.C. 154(b) by 0 days.

(21) Appl. No.: 09/315,843

(22) Filed: May 21, 1999

(51) Int. Cl.[7] ..... B22D 11/00
(52) U.S. Cl. ..... 164/476; 164/417; 164/477
(58) Field of Search ..... 164/476, 477, 164/417

(56) References Cited

U.S. PATENT DOCUMENTS

| | | | | |
|---|---|---|---|---|
| 4,675,974 | | 6/1987 | Connolly . | |
| 5,050,418 | * | 9/1991 | Grotepass | 72/201 |
| 5,461,896 | * | 10/1995 | Abbey, III et al. | 72/181 |
| 5,490,315 | | 2/1996 | Kostopolos et al. | 29/527.7 |
| 5,771,560 | * | 9/1998 | Meroni t al. | 164/477 |
| 5,810,069 | * | 9/1998 | Flick et al. | 164/477 |

FOREIGN PATENT DOCUMENTS

| | | | |
|---|---|---|---|
| 0 302 257 A1 | | 2/1989 | (EP) . |
| 0 309 656 A1 | | 4/1989 | (EP) . |
| 0 353 487 A1 | | 2/1990 | (EP) . |
| 0 499 851 A1 | | 8/1992 | (EP) . |
| 0 648 993 A1 | | 4/1995 | (EP) . |
| 0 761 327 A1 | | 3/1997 | (EP) . |
| 0 770 433 A1 | | 5/1997 | (EP) . |
| 0 862 954 A1 | | 9/1998 | (EP) . |
| 0 867 239 A2 | | 9/1998 | (EP) . |
| 0 872 288 A2/A3 | | 10/1998 | (EP) . |
| 2 672 378 | | 8/1992 | (FR) . |
| 58-164731 | * | 9/1983 | (JP) . |
| 64-53709 | | 3/1989 | (JP) . |
| 9-182907 | | 7/1997 | (JP) . |
| WO 98/56517 | | 12/1998 | (WO) . |

OTHER PUBLICATIONS

Dynamic Simulation of Dual–Line Continuous Strip Processing Operations, Iron and Steel Engineer, Jun. 1997.

Steel Times International—Incorporating Iron & Steel International, GB, FMJ, International Publications, Redhill, Surrey, England, vol. 19, No. 2, p. 8–9 * p. 9, figure * (no date available).

Cone C: "Reheating Furnances for Continuous Steelmaking" Iron and Steel Engineer, US, Pittsburgh, vol. 9, No. 44, Sep. 1967 * p. 122, right–hand col., line 17–line 35: figure 6 *.

"Net and Near Net Shape Continuous Casting: Developments In Thin Slab Casting", R. Gottardi, et al., *Steel Times,* Nov. 1992.

U.S. application Ser. No. 09/315,845, filed May 21, 1999.
U.S. application Ser. No. 09/315,848, filed May 21, 1999.
U.S. application Ser. No. 09/315,847, filed May 21, 1999.
U.S. application Ser. No. 09/315,846, filed May 21, 1999.
U.S. application Ser. No. 09/315,844, filed May 21, 1999.

* cited by examiner

*Primary Examiner*—Tom Dunn
*Assistant Examiner*—Kevin McHenry
(74) *Attorney, Agent, or Firm*—Armstrong, Westerman, Hattori, McLeland & Naughton, LLP

(57) ABSTRACT

An integrated plant for the production of elongated metal product of relatively small cross section, such as bars and rods, is described in which the product is initially cast in a pair of continuous casters and conducted along parallel conveyor lines toward a rolling mill which is in-line with one of the conveyor lines. A tunnel furnace operative to heat the product to rolling temperatures contains transfer mechanism for transferring product on the out-of-line conveyor to the in-line conveyor whereby the benefits of substantially continuous rolling of the product is achieved. A method for operating the plant is also described.

28 Claims, 20 Drawing Sheets

INTEGRATED PLANT FOR THE PRODUCTION OF ROLLED STOCK

FIELD OF INVENTION

The present invention relates to an integrated plant for the production of elongated metal products, such as bars or rods, and the like. More particularly, the invention involves an integrated plant in which an elongated metal product is produced in a continuous caster and is thereafter directly operated upon in a rolling mill apparatus disposed in-line with the caster in a substantially continuous sequence. Moreover, the invention relates to an integrated plant for the production of elongated metal products starting from the liquid steel upstream of the continuous caster and, with an automatic and continuous process, obtaining a quality finished product, already treated thermally and in its surface. All the indispensable operations for arriving at the finished and packaged product are executed in line with benefits both as to material yield and as to the mill utilization factor.

BACKGROUND OF THE INVENTION

Various systems are known for the production of cast, hot rolled and heat treated products, such as bars or rods, and the like. However, such processes conventionally utilize off-line heat treating and metal processing facilities.

It has commonly been the practice to separate the caster and the rolling mill in order to enable product which has been prepared by a variety of preliminary processing procedures to be preliminarily processed and thereafter introduced to the rolling line. More recently, since the development of "hot charging" processes, it is known to provide transport means and storage devices for handling cut to length billets or blooms and to introduce them while hot to a heating furnace. While this practice saves energy and reduces the need for billet storage, it suffers the drawbacks of reduced material output due to the need for cropping the cast product into short lengths, the presence of short bars in the bed, and the generation of scale in the furnace.

Although several of these defects have been overcome by the method for the continuous casting of long products as described in European Patent Application No. EP 0 761 327 to Meroni, et al. and in a co-pending U.S. patent application Ser. No. 09/315,844 entitled "Endless Casting Rolling System With Single Casting Stand" by the inventor hereof, both of which patent applications are assigned to the assignee hereof, the disclosed methods suffer from their own drawbacks in that the rolling mill is essentially dedicated to a single caster and casting line, and is therefore restricted to rolling speeds which conform substantially with the casting speed of product from the caster. Consequently not only may production output be reduced, but also limitations are imposed on the performance of the rolling mill.

It is to the amelioration of these drawbacks that the present invention is directed.

SUMMARY OF THE INVENTION

In accordance with the present invention there is provided apparatus for the production of elongated rolled product comprising continuous casting equipment operative to produce a plurality of parallel lines of elongated product, a rolling mill positioned downstream of the continuous casting equipment in alignment with one of the lines of product, and a tunnel furnace disposed intermediate the continuous casting equipment and the rolling mill along the one line of product. The tunnel furnace has a length at least equal to the length of the product received from the continuous caster and a width effective to enclose all of the plurality of parallel lines of product. Means are provided for sequentially transferring product within the tunnel furnace from a line other than the one line of product into the one line of product for delivery to the rolling mill.

It is accordingly an object of the invention to provide a production line which is adapted for the production of elongated product, particularly, in the form of bars or rods in which the yield of the plant is optimized.

It is a further object of the invention to provide a line for the production of elongated bar or rod product in which the size of the heat treating and metal processing facilities of the plant is minimized, thus to provide production efficiencies.

It is yet another object of the invention to provide a production facility in which the operating speed of the casting equipment may not dictate the operating speed of the rolling mill.

It is another object to provide a casting strand aligned with the rolling mill that can be used to continuously feed the mill without intermediate bar cuts. The plant therefore offers, on the one hand, the advantage of using a single strand thereby obtaining high performances, and on the other, the possibility of using two or more strands thus achieving greater operational flexibility.

It is a still further object of the invention to provide a facility in which production output is increased through the use of plural casters.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENTS OF THE INVENTION

The disclosed invention is particularly directed to a plant 10 for the production of "long products", i.e. billets or blooms from about forty meters or more in length, used in the production of bars, wire, rod, rebar, or shaped beams or angles, and the like, in which the production machinery utilized is typically smaller in size than that used in the production of sheet material from slabs. As used herein, the word, "billet", shall include blooms or slabs, or other strand forms produced by a continuous caster and useful in the production of the aforementioned intended product.

Figure 1:
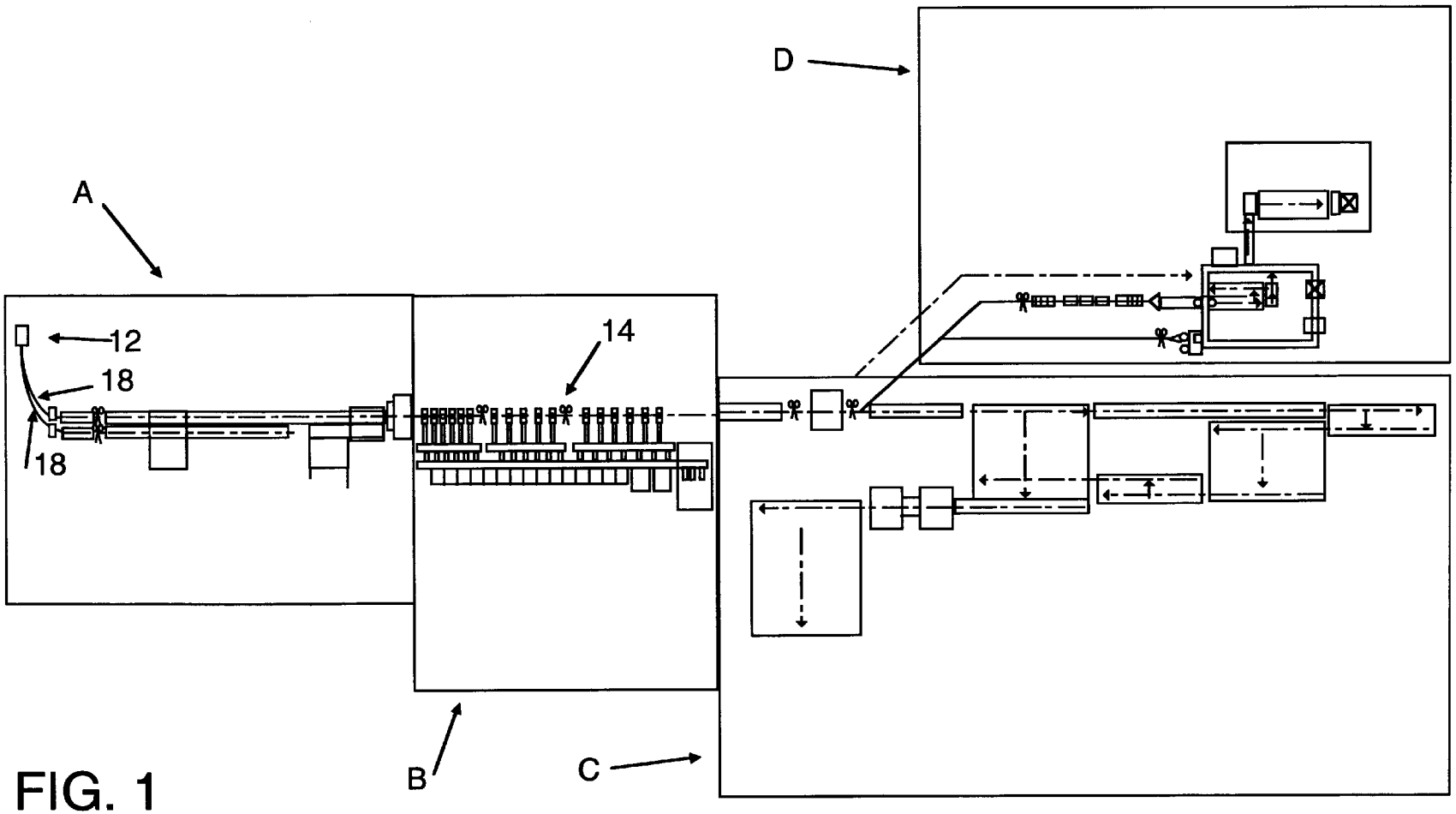
FIG. 1 is a schematic representation illustrating an overall plant layout incorporating the invention.

FIG. 1 of the drawings shows a schematic representation of an overall plant layout suitable for the practice of the present invention. The described plant comprises a casting/mill entry area A, a rolling mill/stands store area B, a finishing area C for the in-line heat treatment of product; and a finishing area D for the in-line heat treatment of wire rod and bars. A description of the respective areas of the plant is presented hereinafter.

A. The Casting/Mill Entry Area

As shown in the schematic representation of FIG. 1, the casting/mill entry area A of the plant includes that area of the plant beginning with the continuous casting equipment 12 and extending essentially to the entrance to the roughing mill stand 16 of the rolling mill 14.

Figure 2:
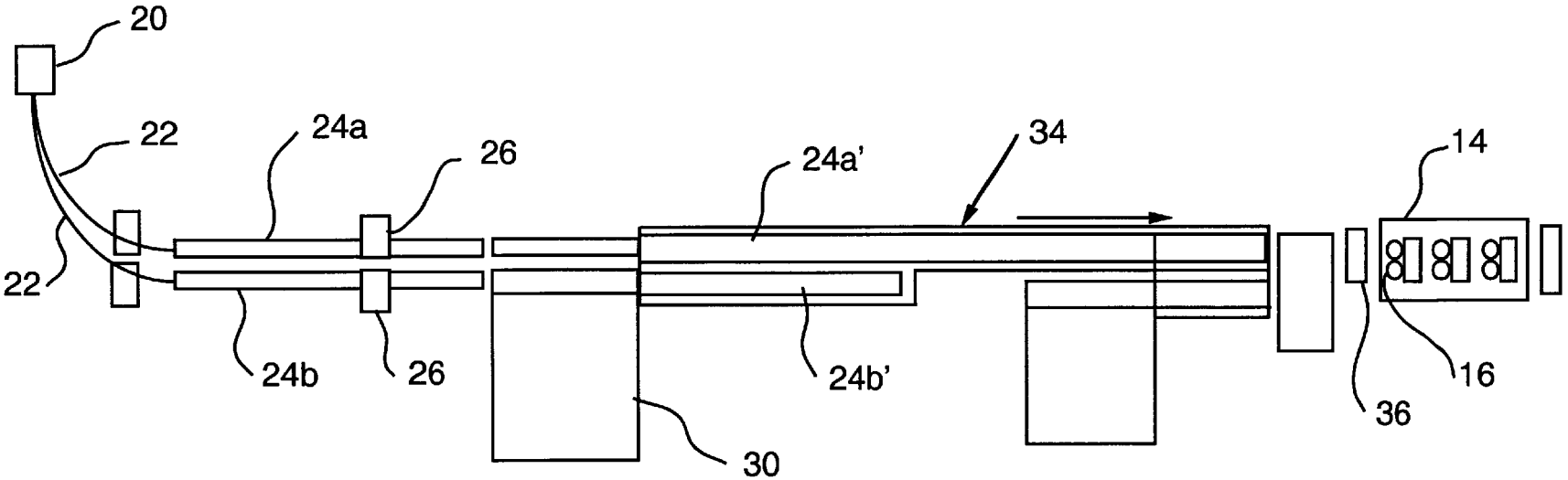
FIG. 2 is a somewhat enlarged schematic of the casting/mill area of the plant shown in FIG. 1.

In FIG. 2 the production line is shown in somewhat more detail as containing continuous caster equipment 12 which may be operable for producing a pair of billets 18. The caster equipment 12 comprises a mold 20 which, as is well known, receives molten metal from a tundish (not shown), or the like, and delivers a plurality (here shown as a pair) of billet strands 22 to a conveyor 24, typically a roll conveyor, suitable for conveying high temperature metal product. Depending upon the ultimate shape of the product to be produced, the caster strands may be billet strands, as embodied in the described line, or they may be of bloom or other dimensions. In either event, the plant 10, being intended for the production of rolled bar, wire product or other elongated shaped product, will produce strands of predetermined dimensions suitable for the ultimate production of the desired elongated product.

The illustrated production line contains a pair of in-line shears 26 which may be of the blade or flame-type. A quenching box 28, a cooling bed 30 and a reheat furnace 32 optionally may also be disposed in an "in-line" configuration in the production line. A tunnel furnace 34, whose principal function it is to heat up and to equalize the temperature of the billets and to bring them to a rolling temperature prior to their being passed to the rolling mill 14, as hereinafter more fully described, is provided upstream of the roughing mill stand 16. A dividing and cropping shear 26 is disposed in each of the lines for cutting the product strands to length, which is contemplated to be upwards of forty meters in length.

According to the invention, one of the conveyors, indicated as 24*a* in the drawings, and adapted to receive one of the billet strands 22 from the caster, extends the length of the production line in alignment with the entrance to the rolling mill 14, as determined by the entrance end of the roughing mill stand 16. The adjacent conveyor, indicated as 24*b* in the drawings, extends parallel to the first conveyor 24*a* continuously from its position to receive a billet strand and convey it to a position spaced inwardly of the outlet of the tunnel furnace 34.

Advantageously, a descaling assembly 36, as shown in FIG. 2, can be disposed in conveyor line 24*a* intermediate the discharge end of the tunnel furnace 34 and the entrance to the roughing mill stand 16. The descaling assembly 36 may be of any well known type but preferably is of the water-operated type including rotary nozzles (not shown) providing a high pressure impact and a low overall rate of water flow so as to reduce to a minimum the loss of temperature from the billet 18 passing to the rolling mill. Between the tunnel furnace 34 and mill inlet, in an advantageous position between the descaler 36 and the mill 14, an on-line conditioning device 35 can be provided which enables an efficacious elimination of surface defects before entering the mill. The device 35 may comprise in-line grinding systems or in-line scarfers using a special flame for eliminating the billet surface layer.

The tunnel furnace 34 may be heated by any of a number of available heating sources including free flame burners, radiating pipes, induction heaters, or any combination of these, either with or without a protective atmosphere. The tunnel furnace 34 is of a size to receive both conveyors 24*a* and 24*b* and is of a length to accommodate the product being conveyed along the respective conveyors. Exiting the tunnel furnace 34, as illustrated, is the tunnel furnace discharge end of conveyor 24*a* which is aligned with the entrance to the roughing mill stand 16.

Figure 3:
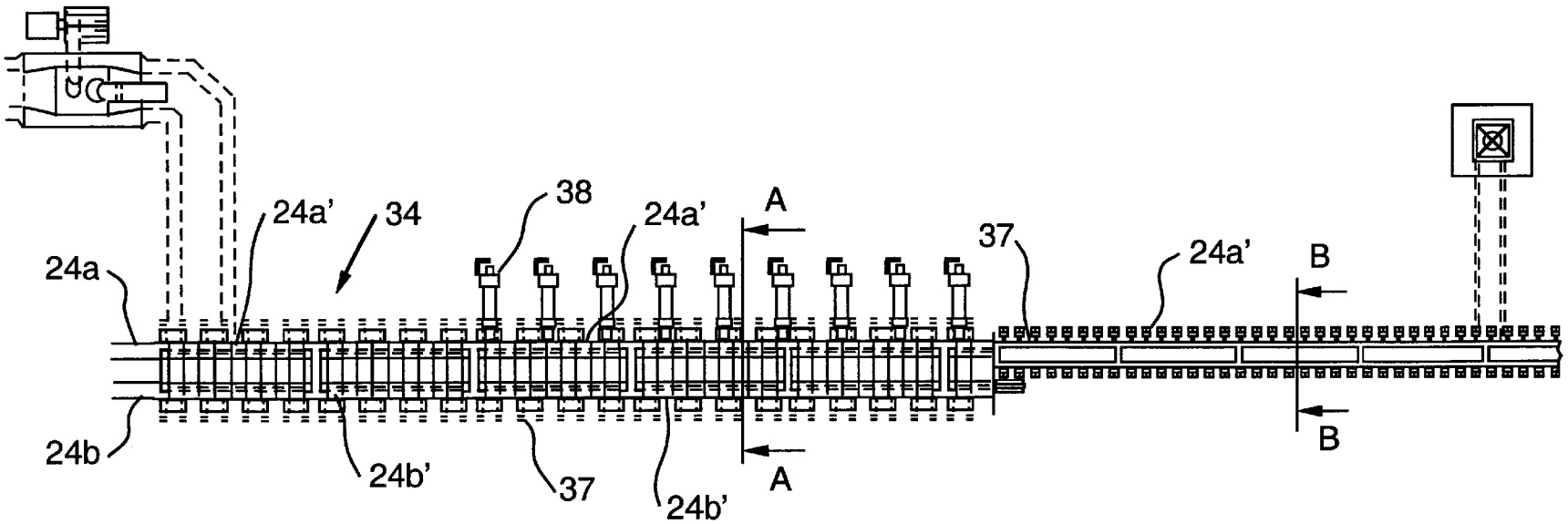
FIG. 3 is a plan view of a tunnel furnace and outlet conveyor therefrom of the type suitable for use in the plant shown in FIG. 1.
Figure 4:
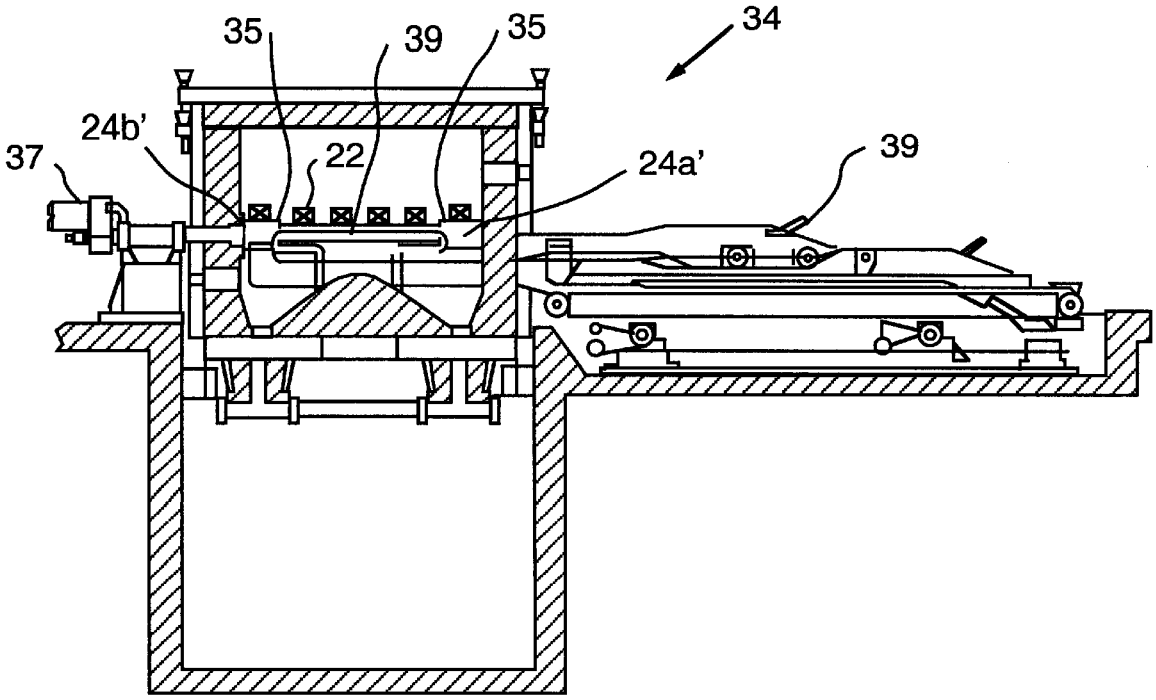
FIG. 4 is a sectional view of one embodiment of the tunnel furnace taken along line A—A of FIG. 3.
Figure 5:
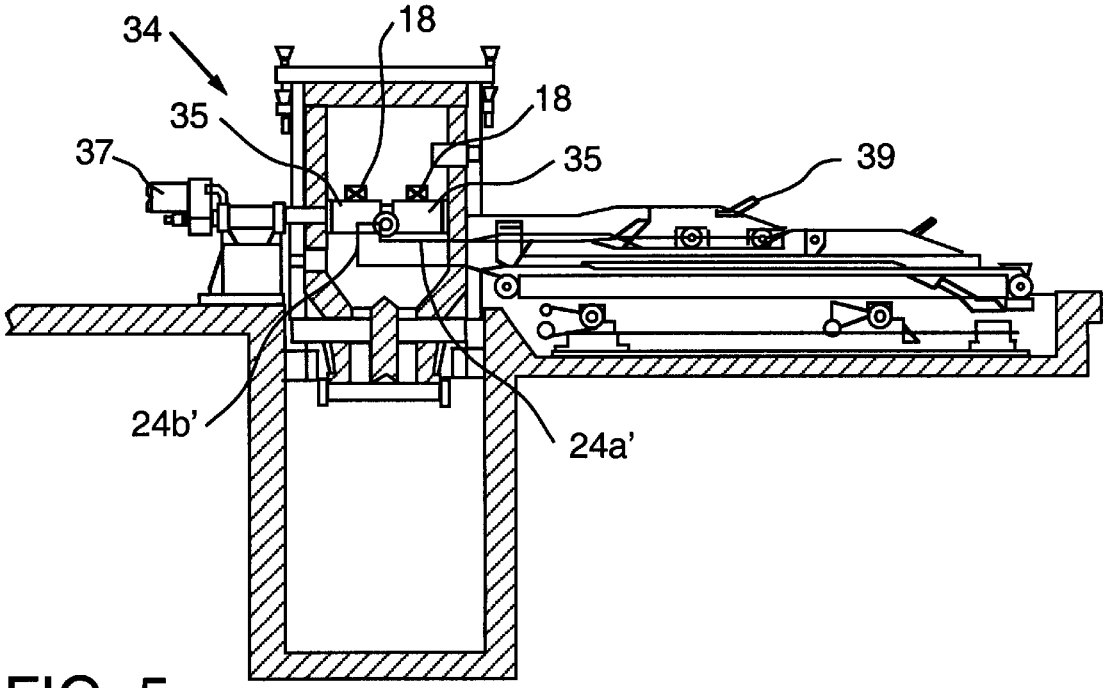
FIG. 5 is a sectional view, similar to FIG. 4, of another embodiment of the tunnel furnace taken along line A—A of FIG. 3.
Figure 6:
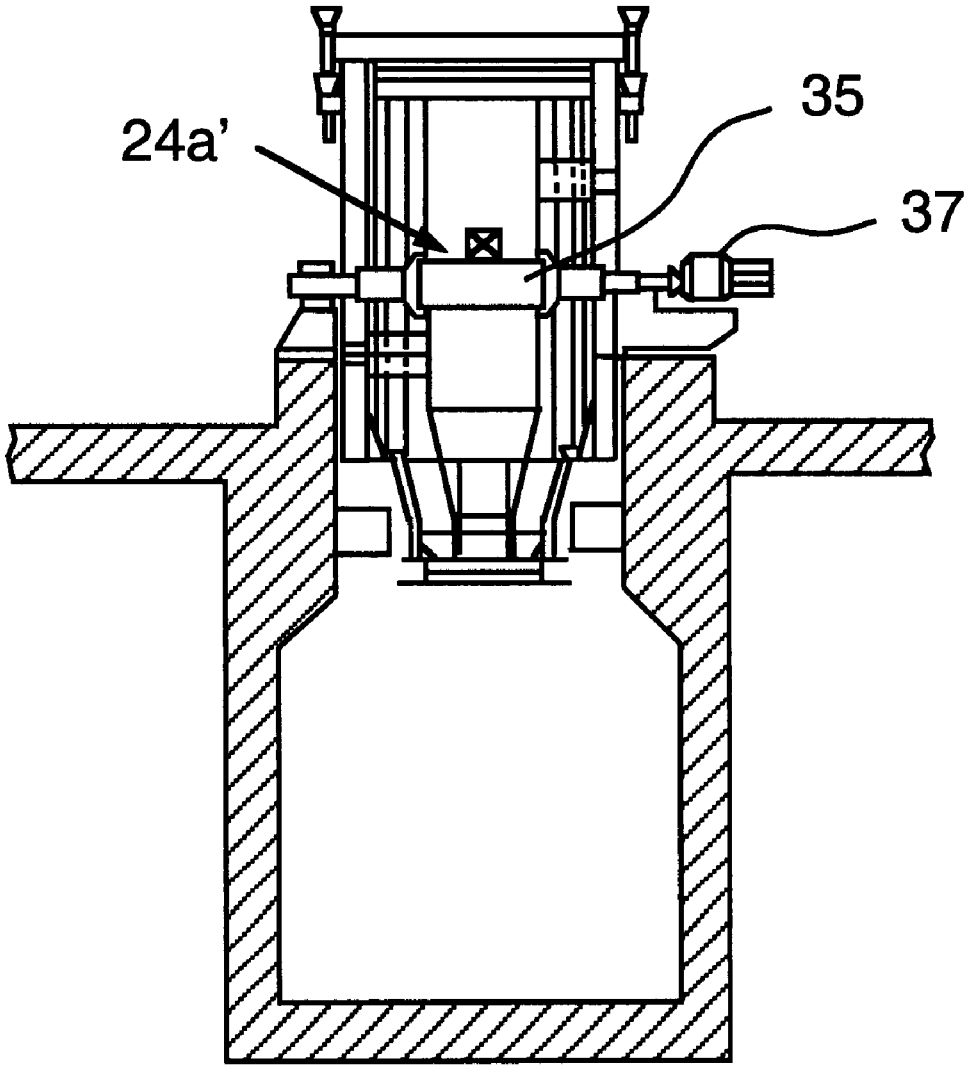
FIG. 6 is a sectional view of the tunnel furnace discharge conveyor taken along line B—B of FIG. 3.

As shown in FIG. 3 the longitudinally parallel conveyors 24*a* and 24*b*, which each comprise a series of transversely parallel rollers 35 rotatably driven by motors 37, are arranged to convey billets 18 from the respective caster strands 22 to the tunnel furnace 34. In the tunnel furnace 34 the conveying rollers are enclosed within walls having a thermal resistant lining. Openings are provided in the furnace walls to accommodate penetration of connecting shafts extending between the motors and the rollers 35. As shown best in FIG. 4 the rollers 35 defining the conveyors 24*a*' and 24*b*' may be mutually separated by conductor beams 39' whose temperature is maintained by a transfer of heat with respect to fluid circulated through heat transfer line 41. In an alternative embodiment of the tunnel furnace 34 shown in FIG. 5, the conductor beams 39' and heat transfer line 41 are eliminated.

According to the invention, means are provided to insure the placement of the billets 18 in close end-to-end alignment at the time of delivery to the rolling mill 16 so that the rolling operation performed on billets from the respective strands 22 is conducted substantially continuously. Thus, as shown, the billet transfer device 38 comprises a series of movable structures 39 that penetrate the furnace wall on one lateral side along substantially the full length of the respective conveyors within the tunnel furnace 34. In operation, those segments of conveyors 24*a* and 24*b* within the tunnel furnace 34, identified as segments 24*a*' and 24*b*', respectively, produce a running velocity for the billets 18 variable in relation to the continuous feeding cycle phase of the billet to the rolling mill. An illustrative operating cycle is described hereafter.

Figure 7:
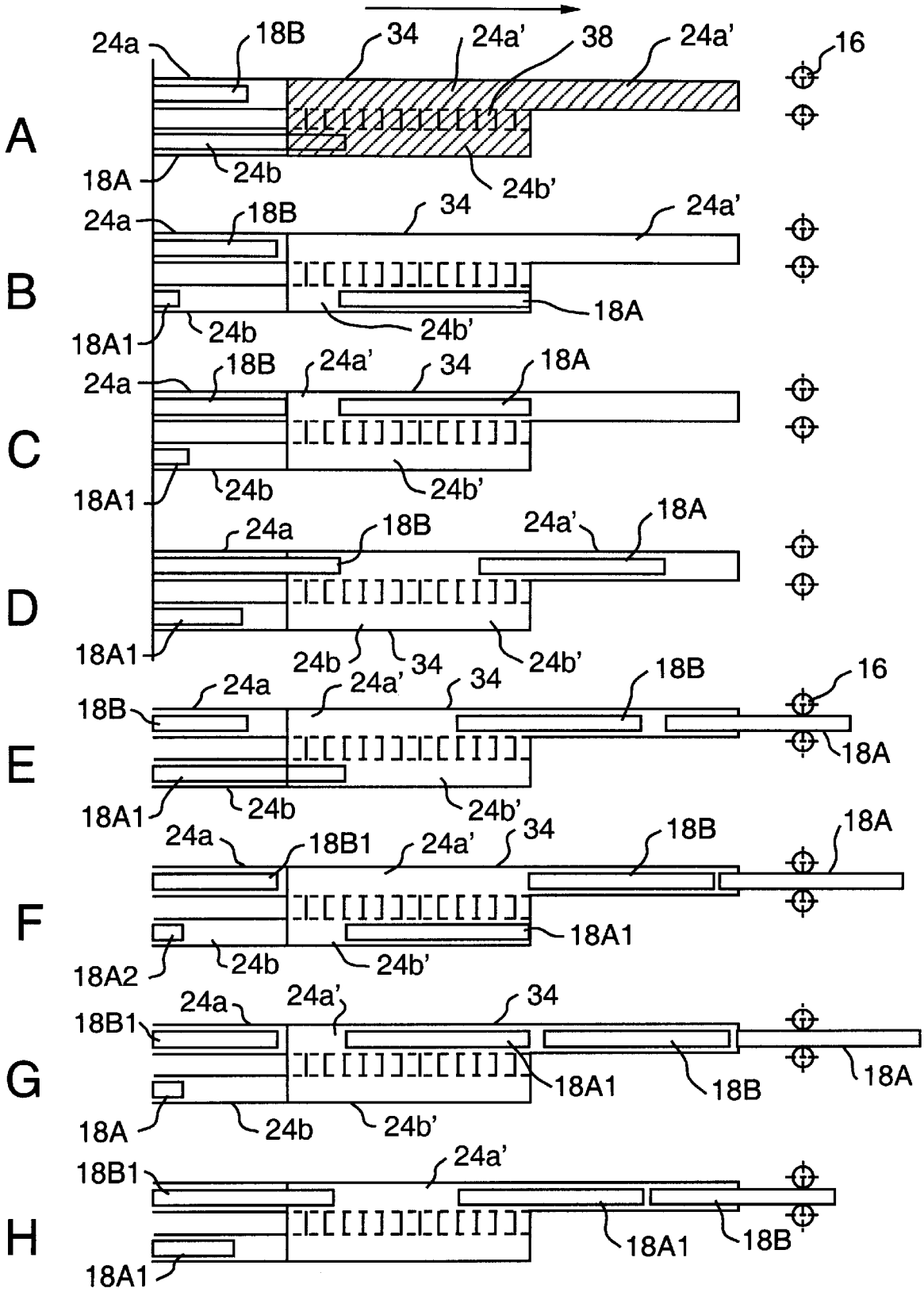
FIG. 7 is schematic diagram consisting of steps A to H indicating the sequencing of billets within the tunnel furnace for transferring said billets from parallel conveyors into alignment on a single conveyor for conduct to the rolling mill in accordance with the present invention.

Consequently the operating procedure of the disclosed equipment can be appreciated from consideration of Steps (A) through (H) in FIG. 7 of the drawings. In operation, with billet $\mathbf{18}_A$ on conveyor 24*b* and billet $\mathbf{18}_B$ on conveyor 24*a* and lagging billet $\mathbf{18}_A$, billet $\mathbf{18}_A$ enters the tunnel furnace 34 and is received upon conveyor 24*b*' (Step A). Due to the increased velocity of conveyor 24*b*', billet $\mathbf{18}_A$ is moved at a greater velocity to the end of the conveyor and stopped (Step B). In the meantime, immediately prior to the entry of billet $\mathbf{18}_B$ on conveyor 24*a* into the tunnel furnace 34, billet $\mathbf{18}_A$, by operation of the transfer apparatus 38, is transferred from conveyor 24*b*' to conveyor 24*a*' in forwardly spaced relation from billet $\mathbf{18}_B$ (Step C). Thereafter, billet $\mathbf{18}_A$ and billet $\mathbf{18}_B$ are both conducted on the conveyor 24*a*' with billet $\mathbf{18}_A$ being conducted from the tunnel furnace 34 through the descaling assembly 36 toward the entrance to the roughing mill stand 16 and billet $\mathbf{18}_B$ being simultaneously conducted into the tunnel furnace (Step D).

During this period, a following billet, designated in the drawings as billet $\mathbf{18}_{A1}$, which is in lagging relation with respect to billet $\mathbf{18}_B$ on conveyor 24*a*, has been conveyed by conveyor 24*b* toward the entrance of the tunnel furnace 34 (Steps B to D). Billet $\mathbf{18}_{A1}$, enters the tunnel furnace 34 on conveyor 24*b* to be received on conveyor 24*b*' as billet $\mathbf{18}_B$ is leaving the part of the roller table 24*a* which will then be occupied by billet $\mathbf{18}_{A1}$ (Step E). As indicated previously, the running speeds of the respective conveyors, 24*a*, 24*b*, 24*a*' and 24*b*', are controlled to be time-variable for performing the described working cycle.

As shown in Step (F) billet $\mathbf{18}_A$ is conducted through the roughing mill 16 at rated rolling speed to the position indicated in the drawing figure. While billet $\mathbf{18}_A$ is rolled, billet $\mathbf{18}_B$ is brought to a position immediately adjacent the rearward end of billet $\mathbf{18}_A$ wherein it is substantially contiguous therewith. This establishes sufficient space on conveyor 24*a*' rearwardly of billet $\mathbf{18}_B$ to permit billet $\mathbf{18}_{A1}$ to be transferred to conveyor 24*a*' from conveyor 24*b*' by the transfer device 38. As billets $\mathbf{18}_A$ and $\mathbf{18}_B$ are conveyed at rated rolling speed through the rolling mill and descaling assembly, respectively (Step G), billet $\mathbf{18}_{A1}$ is transferred to conveyor 24*b*' and moved into close, substantially contiguous relation with the rear end of billet $\mathbf{18}_B$ (Step H). At this time billets $\mathbf{18}_{B1}$, $\mathbf{18}_{A1}$ and $\mathbf{18}_{A2}$ are at locations corresponding to billets $\mathbf{18}_B$, $\mathbf{18}_A$ and $\mathbf{18}_{A1}$ shown in Step (D) whereupon the operating cycle continues in a repeating manner.

B. Automated Rolling Mill Administration System

Figure 8:
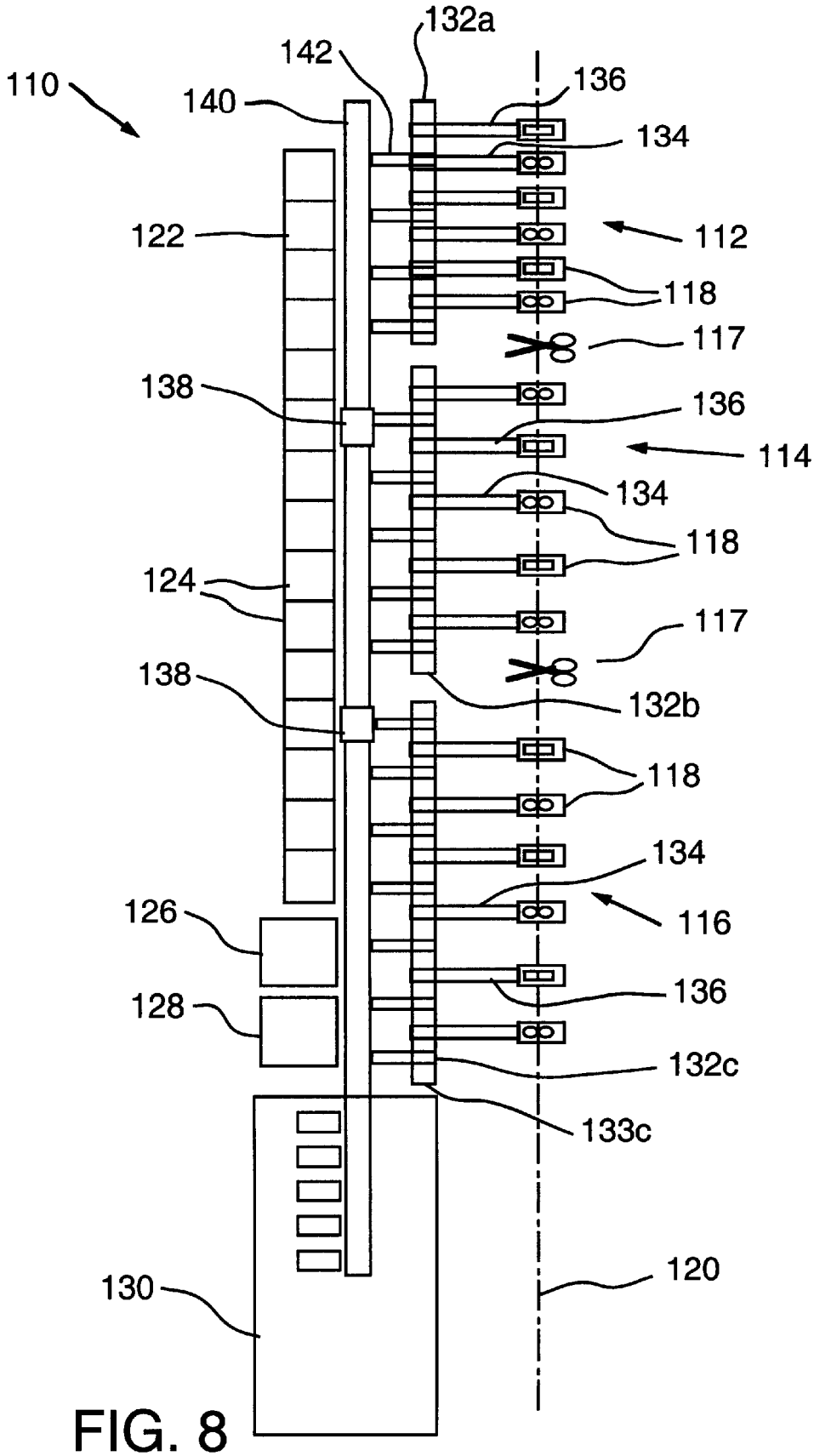
FIG. 8 is a schematic layout of the rolling mills/stand storage area of the plant shown in FIG. 1.
Figure 9:
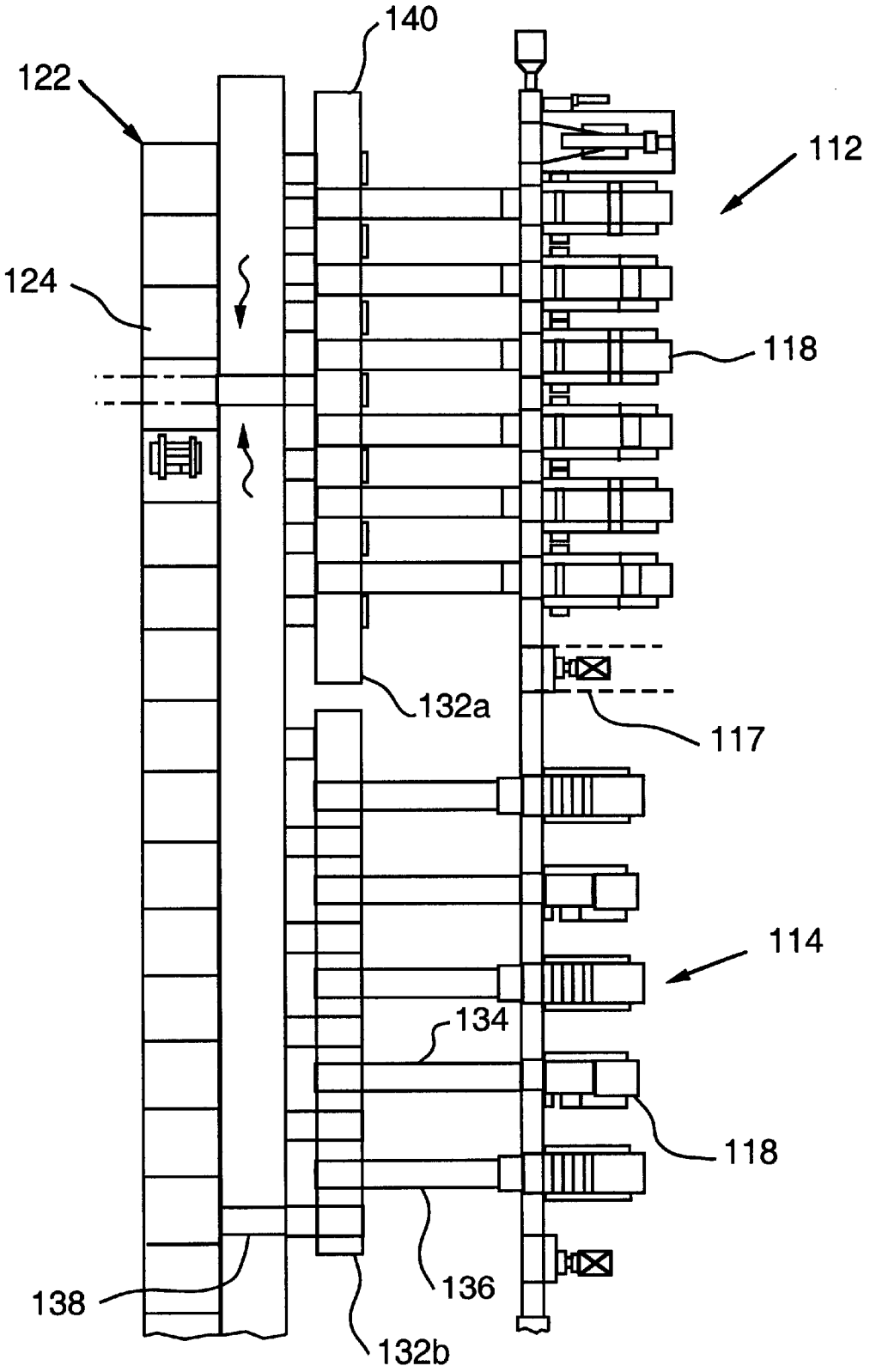
FIG. 9 is a somewhat enlarged illustration of a typical portion of the rolling mill/stand storage area shown in FIG. 8.

With reference to FIG. 8 of the drawings there is shown a general layout of the rolling mill stands storage area 110 of the described plant 10. FIG. 9 illustrates a portion of the equipment in slightly greater detail. As shown, the rolling mill 14 contains sections comprising a roughing mill section 112, an intermediate mill section 114 and a finishing mill section 116, each of which sections contains a plurality of rolling mill stands 118 disposed in-line along a roll pass line 120 identified by a dot-dash line. As shown, the rolling mill stands 118 in the respective mill sections are arranged for the rolling of billets 18 produced by the continuous casting equipment 12 whereby, as shown, the axes of the roll sets of adjacent stands 118 in the respective mill sections 112, 114 and 116 are mutually perpendicularly offset, as is common in the production of elongated metal products, such as bars and rods, or the like, in order to accurately size and shape the product being rolled. Selectively operable shears 117 may optionally be positioned between the respective mill sections.

In addition to the illustrated rolling mill 14, which may include more or less than the number of rolling mill sections shown, as well as more or less than the number shown of mill stands 118 in each rolling mill section, the concerned region of the plant contains a multi-story stand storage area 122 extending parallel to the roll pass line 120. The stand storage area 112 comprises a warehousing facility containing a plurality of stacked compartments 124 arranged in side-by-side relation into which mill stands 118 and by-pass tables (not shown) are housed. Such mill stands 118 may be those that have been removed from the rolling mill 14 and await inspection and refurbishing in the facilities adjacent the stand storage area, which includes a washing cabin 126 wherein the stanis and mill rolls are cleaned, and a tilting device 128 for rotating the mill stands from horizontal to vertical positions, and vice versa.

At the end adjacent the tilting device 128 is a stand set-up area 130 wherein the mill stands may be disassembled in order to replace rolls and reassembled for placement in the stand storage area 122.

Intermediate the mill sections 112, 114 and 116 on the roll pass line 120 and the stand storage area 122 are quick change table means 132, here shown as being separate quick change tables 132*a*, 132*b* and 132*c*, each disposed adjacent one of the respective mill sections. Mechanism (not shown) is employed to enable the respective quick change tables 132 to move linearly forwardly and backwardly for controlled distances by means of a control device (also not shown).

Figure 11:
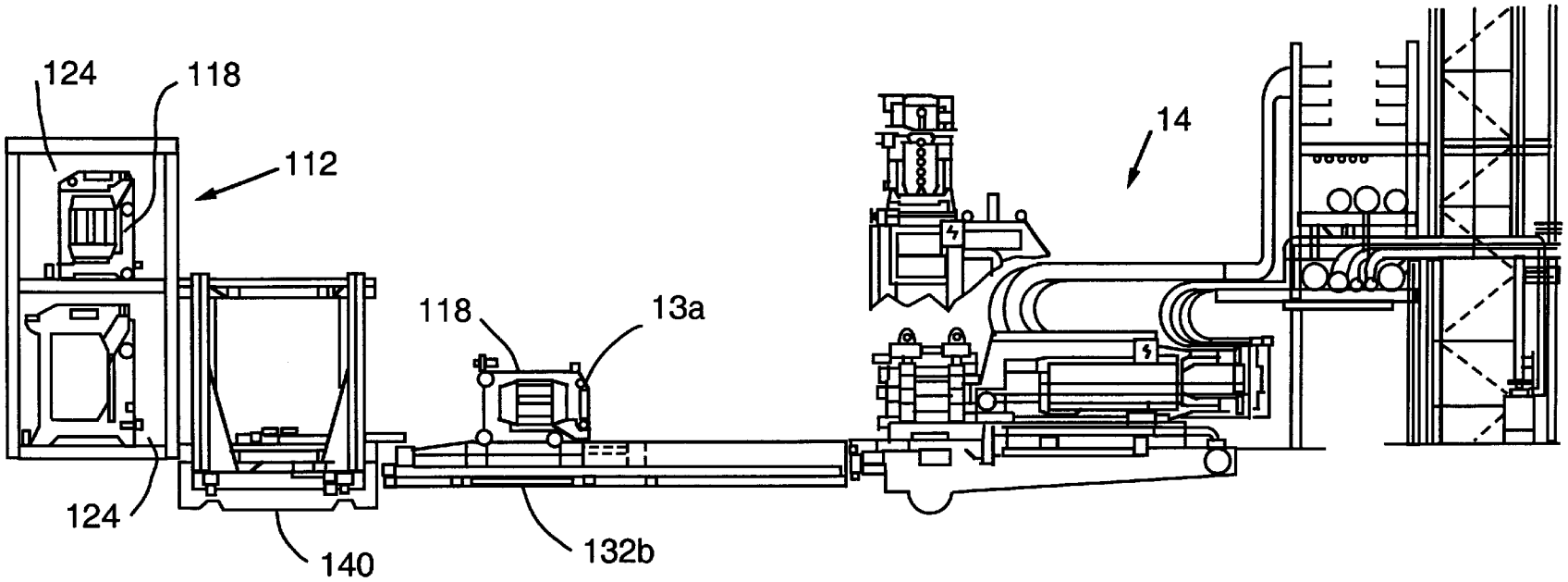
FIG. 11 is a view showing the stands storage area, stand storage robot, quick change device and rolling mill in accordance with the invention.
Figure 12:
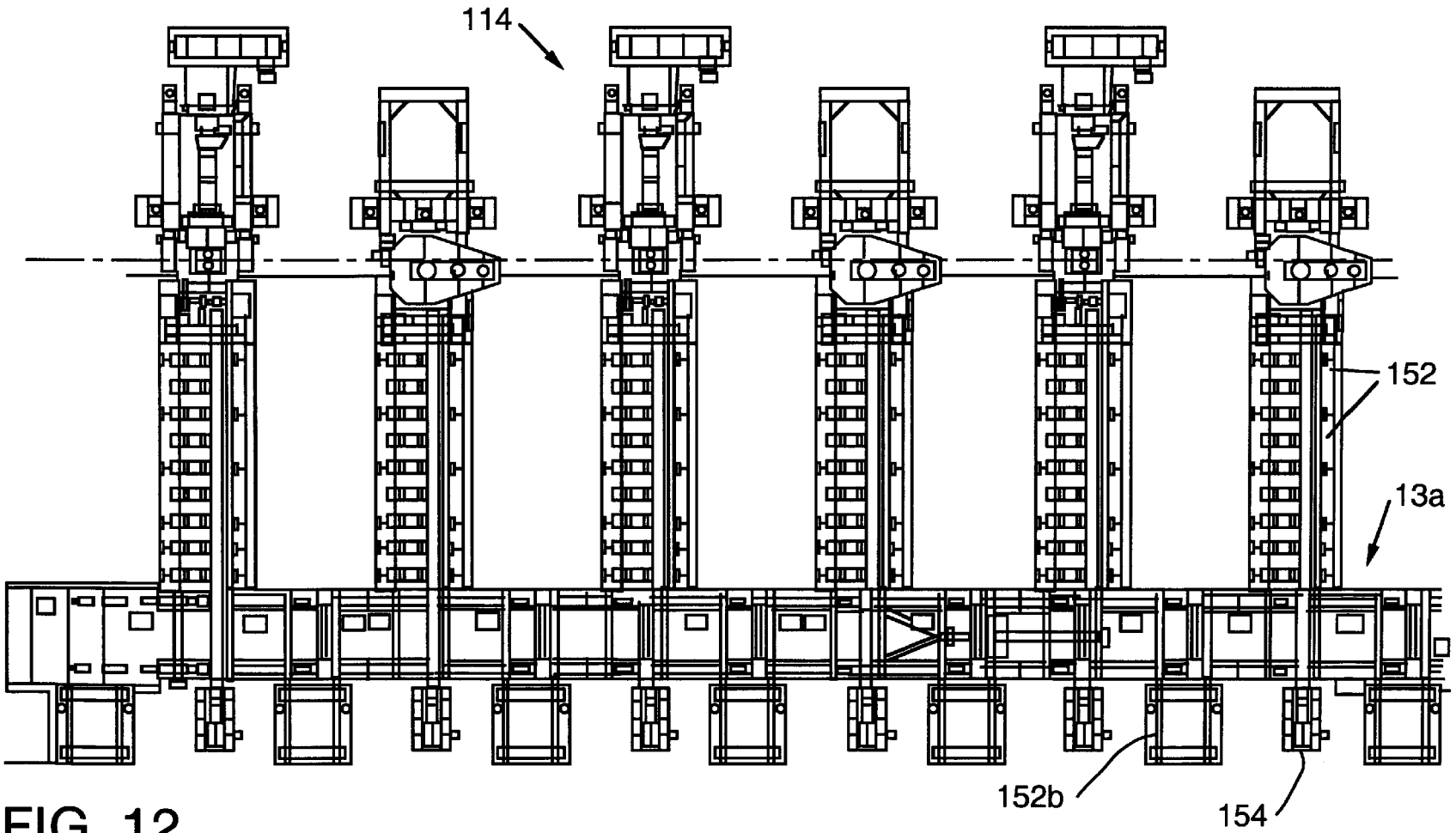
FIGS. 12 and 13 are a plan view and sectional views, respectively, of the quick change device.
Figure 13B:
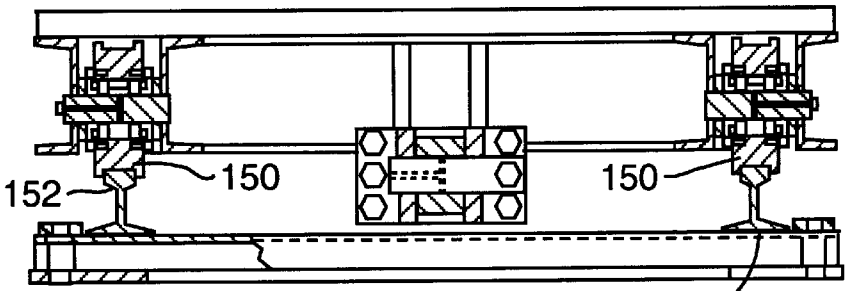
Figure 13D:
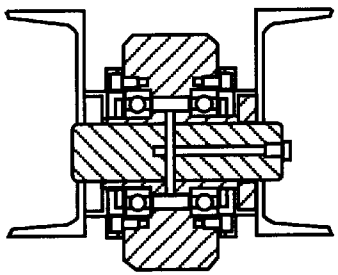
Figure 13A:
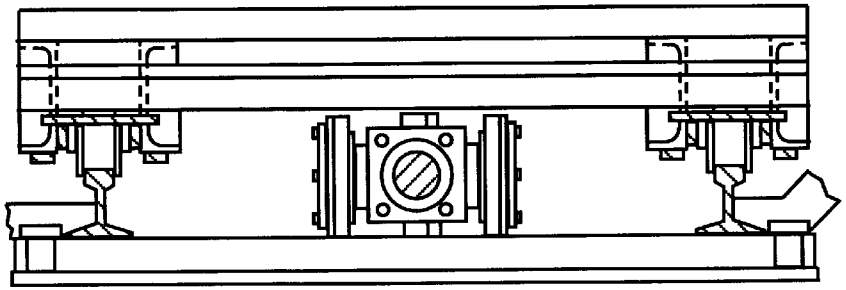
Figure 13C:
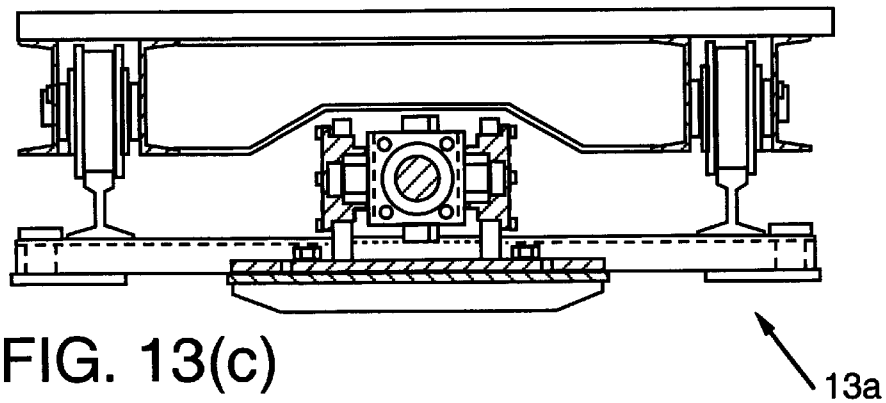

FIGS. 11 and 12 show the quick changing device 13*a* which is used for the removal and replacement of the stands. The cross sections of the quick change device are shown in detail in FIGS. 13(*a*), 13(*b*), 13(*c*) and 13(*d*). The motors 154, shown in FIG. 12, are used to handle the stands (by means, for example, of chain devices) from the quick change device 13*a* towards the rolling axis and vice versa. The stands move along the rails 152 on wheels 150 integrated on the stands. The stands which are on the quick change device 13*a* can be transferred on rails 152*b*, and vice versa. From said position, the stands can be collected or positioned by robot 138. Quick change device 13*a* can be translated in a direction parallel to the rolling axis on a wheeled system 150 and rails 152 due to control systems not shown.

Figure 10:
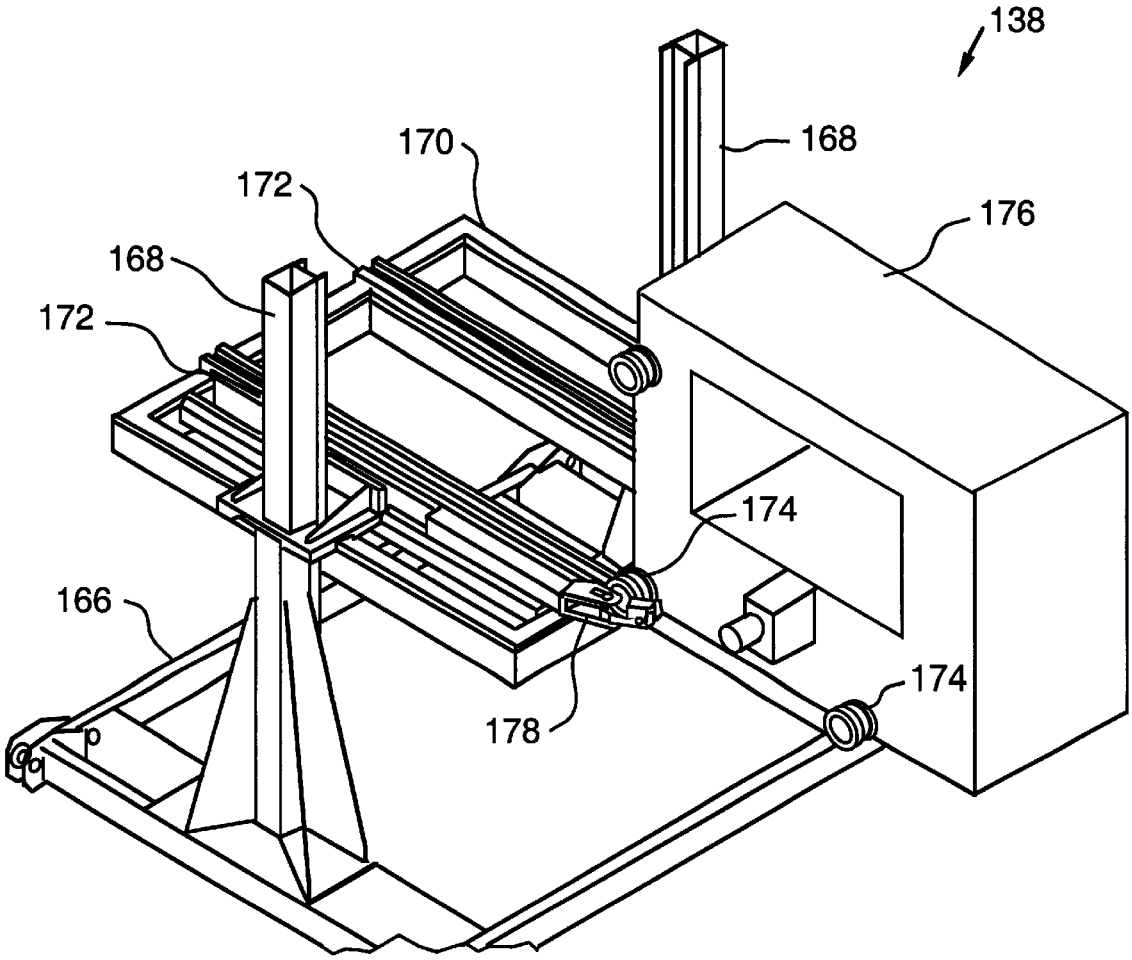
FIG. 10 is a partial perspective view of a typical stand storage robot.

For transferring mill stands 118 between the respective quick change tables 132 and the compartments 124 of the stand storage area 122 a plurality of mobile transfer devices or robots 138 are disposed to move along a robot way 140 that extends intermediate the quick change tables 132 and the stand storage area 122 and parallel to each. Each robot 138, a typical one of which is illustrated in FIG. 10, has the capability of controllably removing a mill stand from a quick change table 132 and transferring it to any selected compartment 124 of the stand storage area, to the washing cabin 126 for cleaning, to the tilting device 128 or to the stand set-up area 130. Conversely, the robots 138 also operate to move mill stands 118 from any of the aforementioned facilities to the quick change tables 132*a*, 132*b* or 132*c*.

As shown, each robot 138 comprises a frame 166 which is controllably movable on wheels along the robot way 140 and carries oppositely spaced upstanding posts 168 forming guideways for a vertically movable base 170. The base 170 has a pair of spaced, parallel tracks 172 that cooperate with stand wheels 174 for securing and manipulating a mill stand 176 to be moved along the robot way 140 for transfer between the quick-change table 132 and one or more of the washing cabin 126, the tilting device 128, or the stand setup area 130 prior to insertion in a selected compartment 124 of the stand storage area. Of course, a mill stand 118 removed from the rolling mill line can be transferred directly to the stand storage area. A stand operator 178 operates to move stand 176 along tracks 172.

The operation of the facility is explained by way of an example as follows. Upon completion of the rolling of a product, such as an elongated bar, rod, beam, angle, or the like, employing ten mill stands 118 is determined that the next product to be rolled requires the use of eight new stands, together with two by-pass tables, to replace the ten mill stands used in the previous product run. It is further determined by a management program that the eight new stands 118 and two by-pass tables (not shown) are available at particular locations in compartments 124 of the stand storage area 122. At this stage, robots 138 are sequentially moved to positions along the robot platform 140 whereby the new mill stands 118 and bypass tables can be sequentially removed from their respective compartments 124 and placed in an assigned position next to the concerned quick change table 132. Next, the new mill stands 118 and by-pass tables are transferred onto the concerned quick change table or tables 132 by the mill stand transfer devices 136 referred to hereinbefore. The used mill stands 118 are likewise transferred onto the respective quick change tables 132*a*, 132*b* and/or 132*c* by the mill stand transfer devices 134.

The respective quick change tables 132, under the control of the management control system, are caused to move linearly in order to sequentially align the new mill stands 118 and by-pass tables with their respective assigned positions in the rolling mill train 14. The used mill stands 118 are similarly moved by the quick change tables 132 to positions from which they are extracted by robots 138, moved to the washing cabin 126 for cleaning, and thence to stand set-up area 130 or to the stand storage area 122 depending upon the needs of the respective mill stands 118. The new mill stands 118 and by-pass tables are, in the meantime, moved by mill stand transfer devices 136 to the rolling mill train 14 and are coupled to the relevant driving and control elements whereupon rolling of a new product can commence.

It will be appreciated that there is provided hereby a rolling mill operation in which the respective components are managed by a computer controlled in response to a database which contains particulars of production campaigns, lives of mill rolls and the product-defining channels therein, and the status of the respective components at any given time, whereby the administration of the respective components of the rolling mill is conducted automatically.

C. In-Line Heat Treatment of Stock

Figure 14:
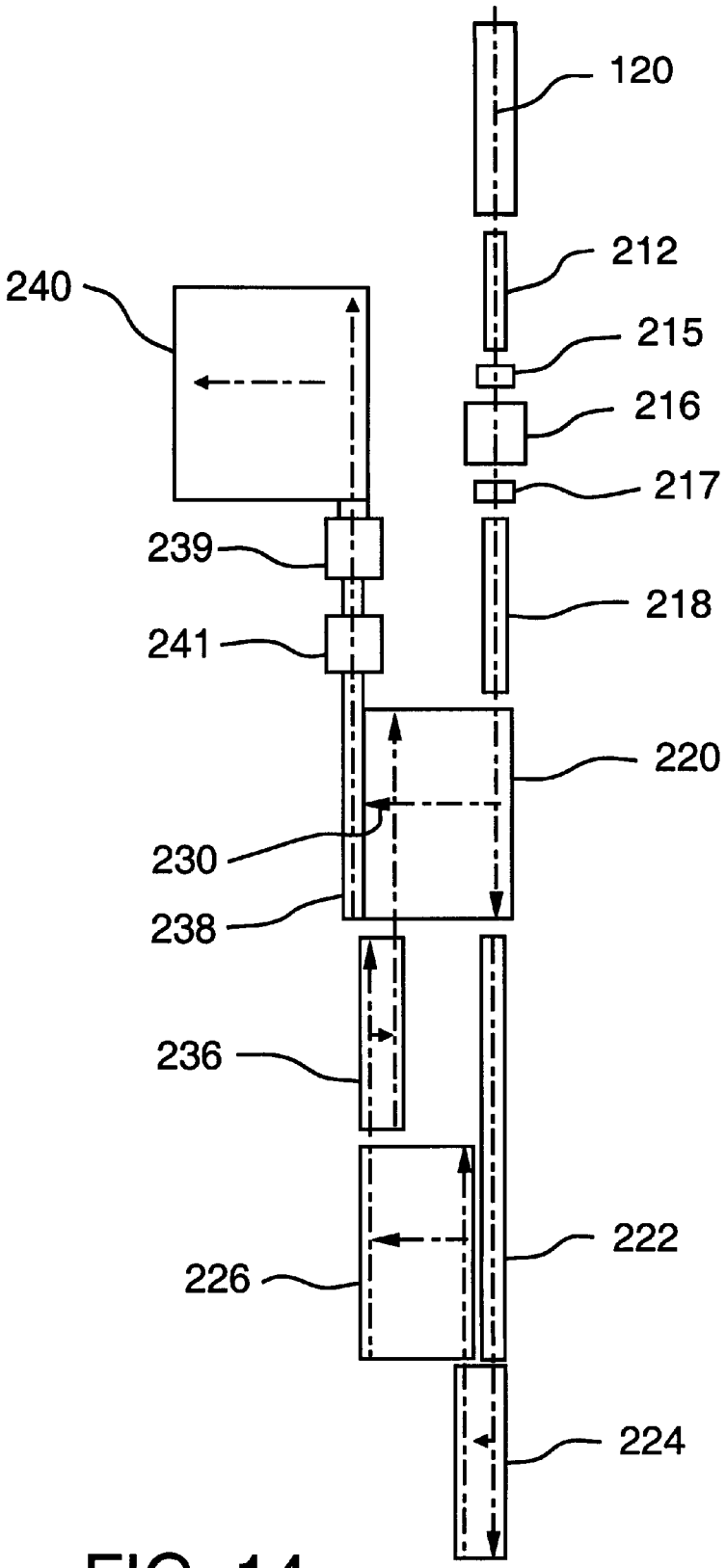
FIG. 14 is a schematic representation of the finishing area for in-line heat treatment as shown in FIG. 1.

As shown in FIG. 14 of the drawings, the metal product pass line, which is an extension of the roll pass line 120 shown in FIG. 8, contains, in-line, a controlling temperature device 212, a reduction and sizing block 216, quenching box 218, cooling bed 220 (optional), induction heaters 222, an integrated device comprising a layers preparation system 224, an annealing chamber 226, and a discharge system 236. Shears 215 and 217 are also provided for head and tail cutting and for cutting-to-length of the rolled stock. A water box 241, an on-line shot blasting 239 and a finishing area 240 are provided in-line downstream of cooling bed 220.

Figure 15A:
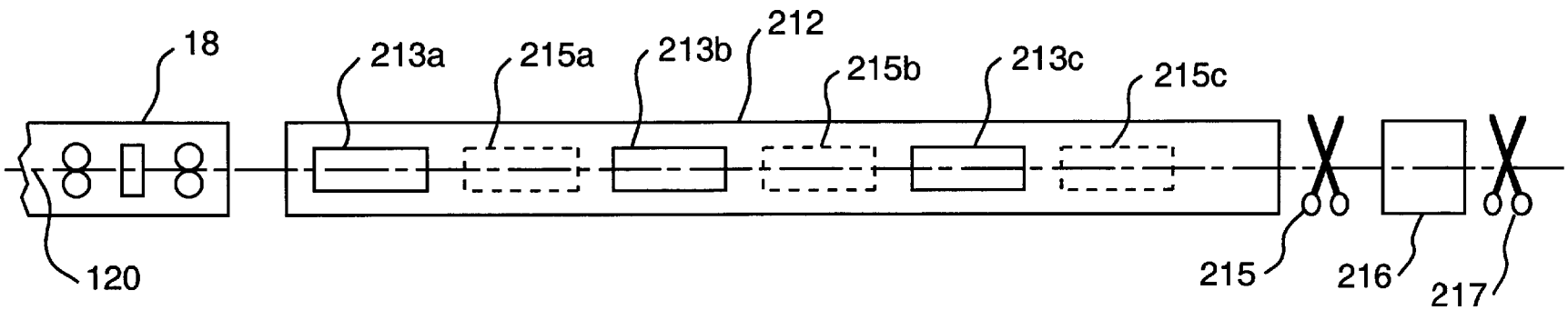
FIG. 15A is a schematic representation of the thermocontrolled rolling zone.

As can be seen in FIG. 15A, the temperature controlling device 212 is made up of a set of water boxes 213*a*, 213*b*, 213*c* and an area between the water boxes and the reduction and sizing block 216, with the aim of equalizing the rolled stock temperature. A set of inductors 215*a*, 215*b*, 215*c* can optionally be provided in an intermediate position between the respective water boxes. Selecting in this way either the water boxes or the inductors it is possible to control and subsequently equalize the rolled stock temperature before entry to reduction and sizing block 216. The controlling temperature device 212, together with the sizing and reduction block 216, permit thermocontrolled rolling of the bars. It is therefore possible to carry out according to the specific requirements either standard rolling, or normalizing rolling, or thermomechanical rolling.

Figure 15B:
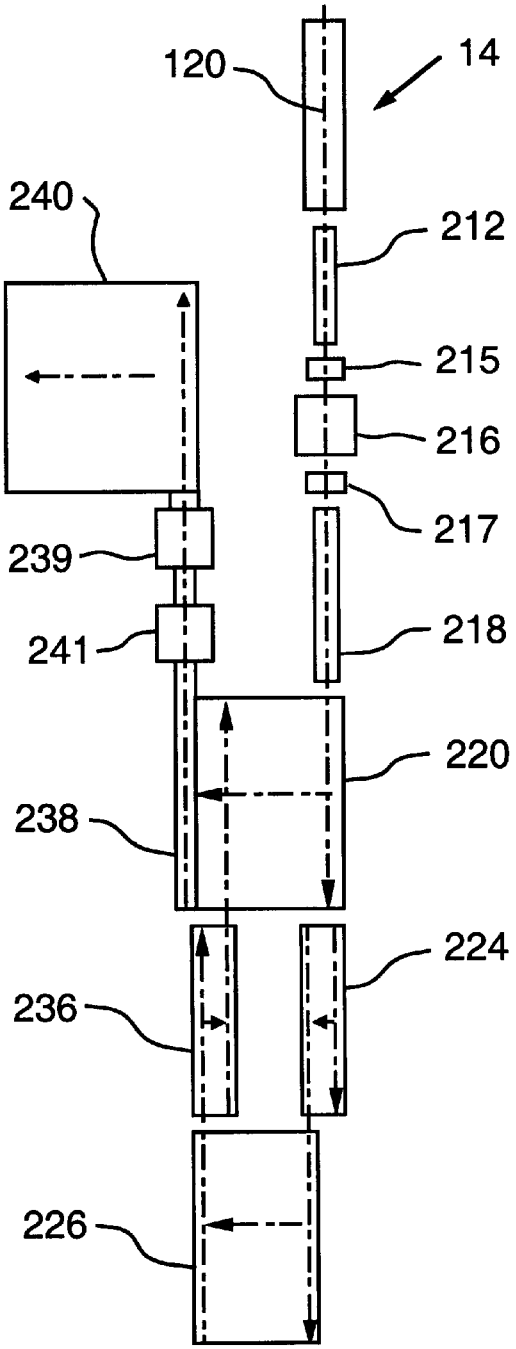
FIGS. 15B and 15C are schematic representations of compact variants of the finishing area for in-line heat treatments as shown in FIG. 1.
Figure 20:
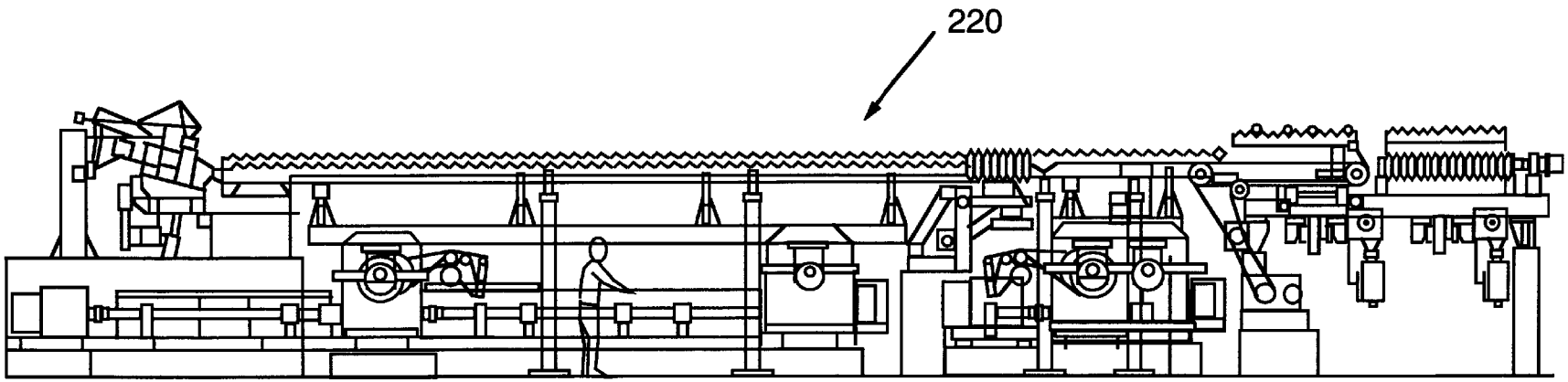
FIG. 20 is a partial elevational view of the cooling bed shown in FIG. 14.

Upon leaving the sizing apparatus 216 the bars are passed to a quenching box 218 in which they are controllably cooled to a predetermined temperature depending upon the desired heat treatment to be performed. Next, the bars may be passed to the induction heated furnace 222 wherein, depending upon the residence time of the bars within the furnace, the bars may be heated for tempering, if desired, or simply heated to an elevated temperature for further processing or for temperature equalization purposes. Alternatively, the bars may simply be diverted through the cooling bed 220, shown in FIG. 20, for cooling to about atmospheric temperature prior to discharge to a bar finishing area 228. In the arrangement shown in FIG. 15B, the induction heaters 222 have been eliminated and heating, if any, of the rolled product takes place directly in the annealing chamber 226 downstream.

Figure 16:
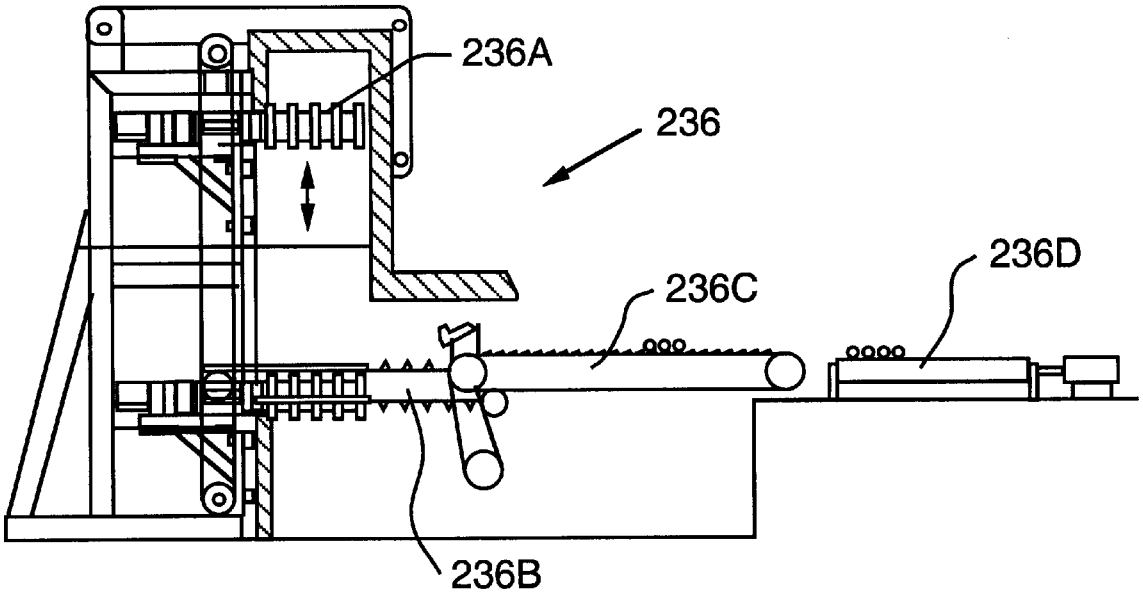
FIG. 16 is partial sectional elevation view of a discharging system shown in FIG. 14.
Figure 19:
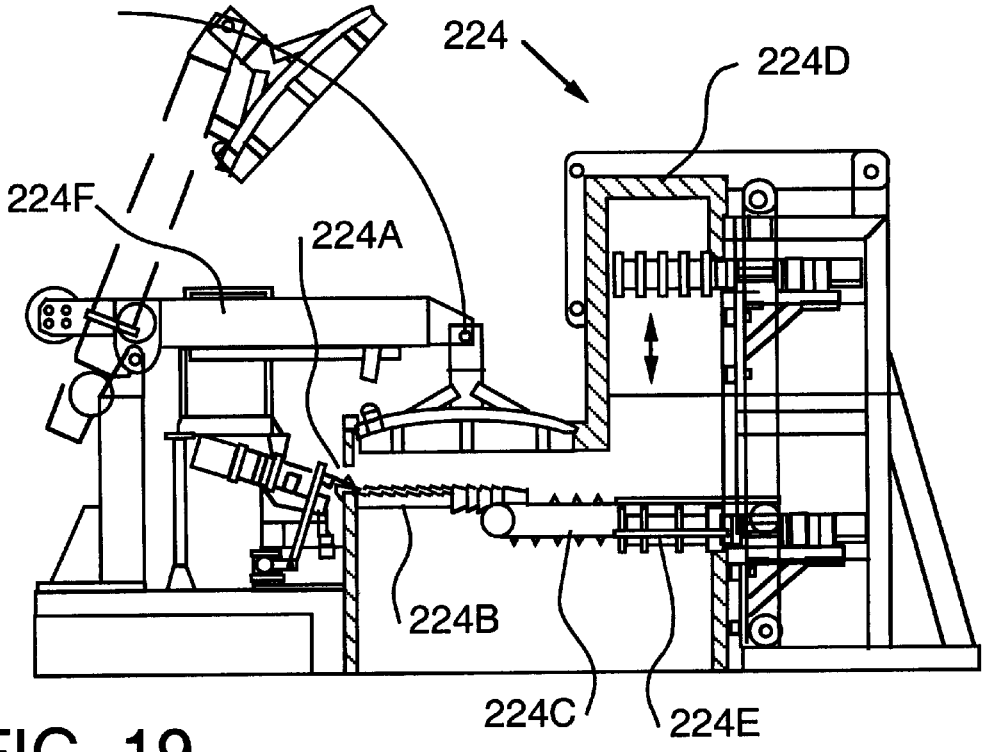
FIG. 19 is a partial sectional view of a layer forming system shown in FIG. 14.
Figure 17:
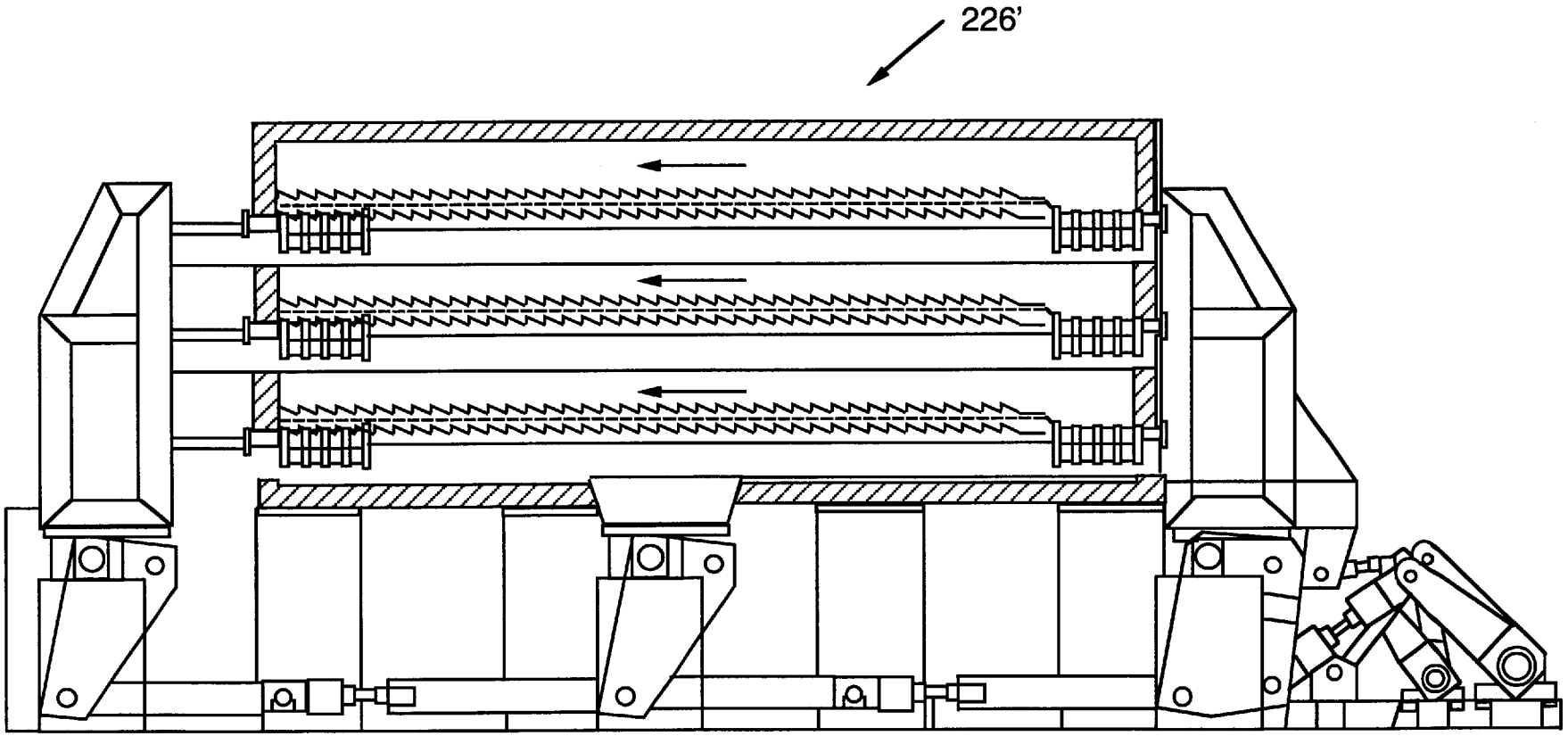
FIG. 17 is a sectional elevation view of a multilevel annealing furnace.

Following the induction heated furnace 222, the bars pass to a layers forming system 224, shown in FIG. 19, from which they are transferred to the annealing chamber 226. The layers forming system 224 includes an enclosing wall having an opening 224A forming an inlet through which bars are passed onto a conveyor 224B for transfer to a layer forming conveyor 224C. The layers, upon leaving conveyor 224C, are transferred to a liftable table 224E which operates to transfer the layers of bars to the annealing chamber 226. Desirably, the layers forming system 224 includes a pivotally retractable cover 224F for overlying the conveyor 224B. The use of a layer forming system similar to the one shown in FIG. 19 is associated in an advantageous manner to the use of an annealing chamber 226' like the one shown in FIG. 17. In this case the annealing chamber is arranged on two or more levels and is used for high productivity plants. The layers formed with the layer forming system, see FIG. 19, are conveyed via a liftable table 224E inside one of the annealing chamber levels. The layers inside the annealing chamber are moved horizontally so that they cover its whole length in a time equal to that set for the heat treatment. The layer handling device inside the chamber is typically a walking beam system. Treated bar layers are discharged by a device which is symmetrical to the feeding device, an example of which is shown in FIG. 16. The bar layer is kept in an insulated place up to the bar separation area in order to limit the cooling of same and guarantee good bar straightness. The layers descend from the various levels due to a liftable table 236A which collects the layer and places it on the transfer 236B. Separation occurs by means of a device similar to the one for layer preparation, arranging the bars on a cooling bed 236C without maintenance hoods where the bars can be cooled without causing straightness problems.

Other possible annealing chamber constructions suitable for use in the practice of the present invention are shown and described in U.S. patent application Ser. No. 09/315,847 filed concurrently herewith and the content thereof is incorporated herein by reference.

Figure 15C:
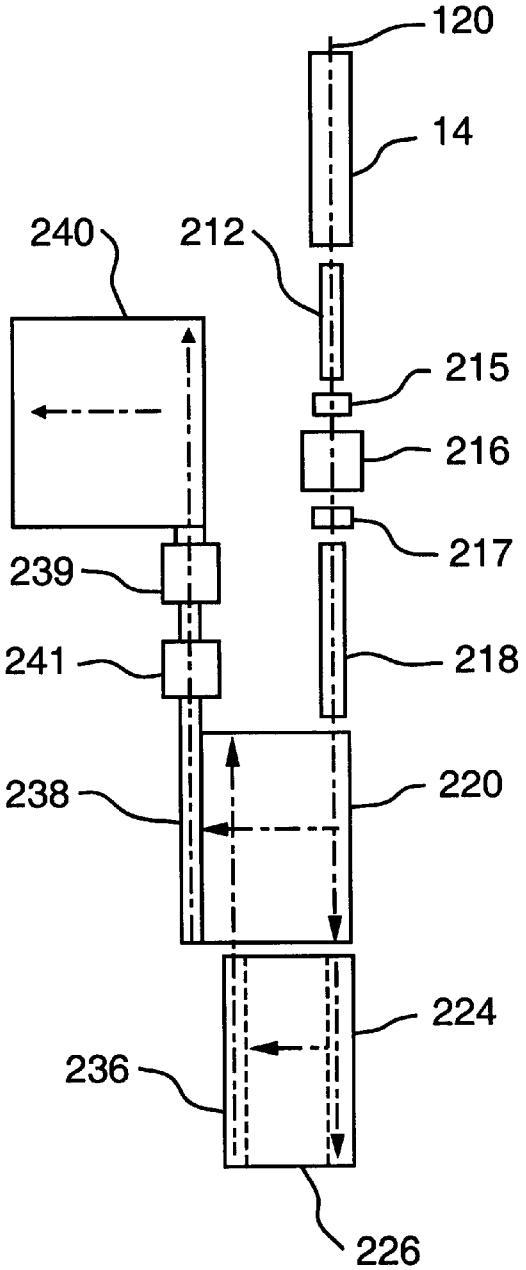
Figure 18:
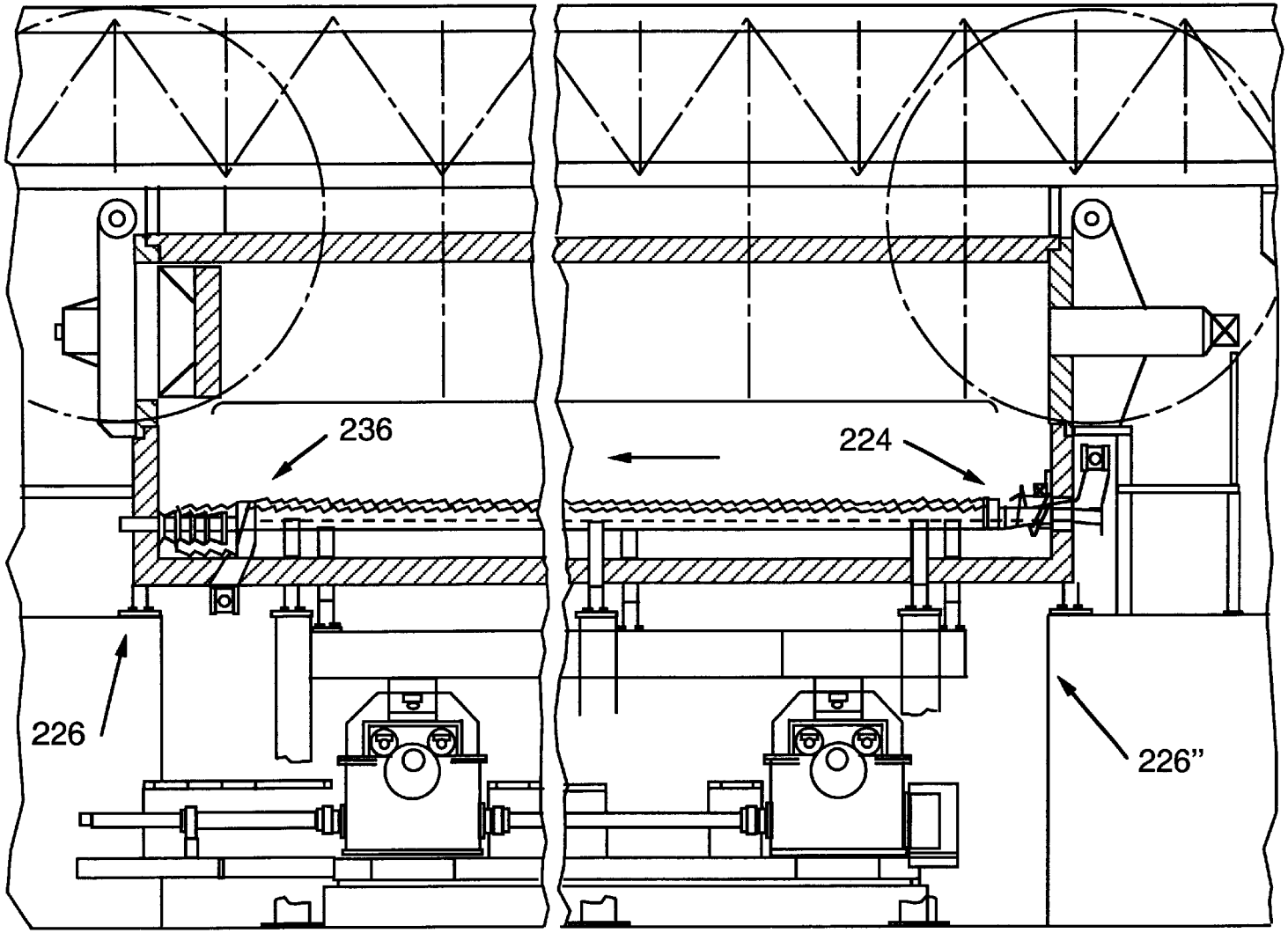
FIG. 18 is a sectional elevational view of a one-level annealing furnace including a layer preparation system and a discharge system.

The integrated device including the layer preparation system 224, annealing chamber 226 and discharge system 236, as described, is mainly used for high productivity plants. In low and medium productivity plants said system can be replaced with a system indicated as 226 having only one level, as shown in FIG. 18, where the layer preparation system and the discharge system are positioned directly inside the annealing chamber on one level only. In this case the over-all plant layout can be further simplified as shown in FIG. 15C.

Within the annealing furnace 226, depending upon the residence time of the bars within the furnace and the furnace operating temperature, the bars can receive a substantial range of heat treatments, such as tempering, workability annealing, spheroidizing-annealing, and slow cooling.

In operation, the general method of the invention for heat treating of steel stock hot rolled in a rolling mill includes the following possibilities conducted in-line with the rolling mill:

1. thermocontrolled rolling of the rolled stock in a thermocontrolled rolling zone constituted by a controlling temperature device 212 and a reduction and sizing block 216;
2. cutting the rolled stock into pieces of predetermined length;
3. sizing in a reduction and sizing block 216;
4. quenching the pieces of hot rolled stock in the quenching box 218;
5. heating the rolled stock in the induction heater 222;
6. preparing layers of predetermined numbers of pieces of stock in the layers preparation system 224 wherein the number of cut pieces of stock per layer depends on the section of the rolled stock and a following annealing time;
7. tempering and annealing the prepared layers of stock in the annealing furnace 226;
8. separating the layers into individual pieces of annealed stock in the discharge system 236; and
9. cooling the heat treated stock in the cooling bed 220, which, together with the other equipment, may be provided with a protective atmosphere, such as hydrogen/nitrogen or other suitable gases.

The particular times and temperature used in the several steps outlined above are selected for each individual product as dependant, for example, on composition and shape of the rolled product, and on its initially rolled and finally desired microstructure. Some specific examples follow.

For spheroidizing annealing the stock, the rolled stock is subjected to a thermocontrolled rolling using the controlling temperature device 212 and the reduction and sizing block 216 at a temperature of about 750° C. to about 850° C., then passed through the quenching box 218 and through the induction heating furnace 222 wherein no cooling or application of heat occurs therein. The thus-treated stock then is passed through the layers preparation system 224 where layers of cut pieces of stock are prepared. The layers of stock then are passed into the annealing furnace 226 at a temperature of from about 680° C. to about 720° C., and held therein for a time from about one hour to about two hours to spheroidize-anneal the stock. Thereafter, the cut pieces of stock in the layers are separated, and are passed through the cooling bed 220 where the product is cooled to substantially ambient temperature for subsequent in-line finishing, such as sandblasting, cutting to final form, and packaging.

In another variant of the general process, i.e. for shearability or workability annealing of the stock, the process is similar to the previously described process, except that the layers of stock are held in the annealing furnace 226 at a temperature of from about 630° C. to about 680° C. for a time from about 30 minutes to about 40 minutes.

For producing recrystallized annealed stock, the cast and rolled stock is subjected to thermo-controlled rolling in the thermocontrolled rolling zone containing the controlling temperature device 212 and the reduction and sizing block 216, and the thus-treated stock is annealed in the annealing furnace 226 at a temperature of about 800° C. and at a holding time of about 30 minutes to about 60 minutes.

For producing quenched stock, cut pieces of the cast and rolled stock are quenched in the quenching box 218. The induction heater 222, the layers preparation system 224, and the annealing furnace 222, the layers preparation system 224, and the annealing furnace 226 are by-passed and the quenched and tempered stock is passed directly to the cooling bed 220 and therein cooled to substantially ambient temperature.

As a still further example, a method for producing quenched and tempered stock, the cast and rolled stock is quenched in the quenching box 218, exits the quenching box at a temperature of from about 50° C. to about 150° C., then is optionally passed into the induction heater 222 and heated therein to the entry temperature to the annealing chamber 226 of from about 300° C. to about 500° C. and then held in the annealing chamber, where the temperature rises to about from 600 to 700° C. for a time of from about one hour to about two hours. The thus-treated stock then is passed directly to the cooling bed 220 and therein cooled to substantially ambient temperature.

Various other in-line treatments may be performed, for example, using the annealing furnace 226 for slow cooling of the product when such slow cooling is required for the treated products.

The overall apparatus of the invention, and the flexibility with which the several in-line items of equipment can be used or not used, and the wide range of choices of heating and cooling times and temperatures responsive, for example, to differing product chemistries and microstructures to produce a variety of different products provides a novel and extremely valuable tool in the production of cast and rolled products, such as bar products. As above noted, the invention also provides substantial and significant savings of time and energy costs as compared to conventional off-line heat treatment processes and facilities.

From the cooling bed 220 the processed bars are conducted via conveyor 238 to the water box 241 where they can be quickly cooled, especially after tempering, thereby reducing the stay time in the temperature range where the fragility of the tempering occurs (450–500° C.). If desired, the processed bars can be conducted to on-line shot-blasting device 239 prior to being discharged to the bar finishing area 240 from whence the bars are transferred to storage or to shipment via a transport facility (not shown).

D. Finishing Area for In-Line Treatment of Bars and Wire

Figure 21:
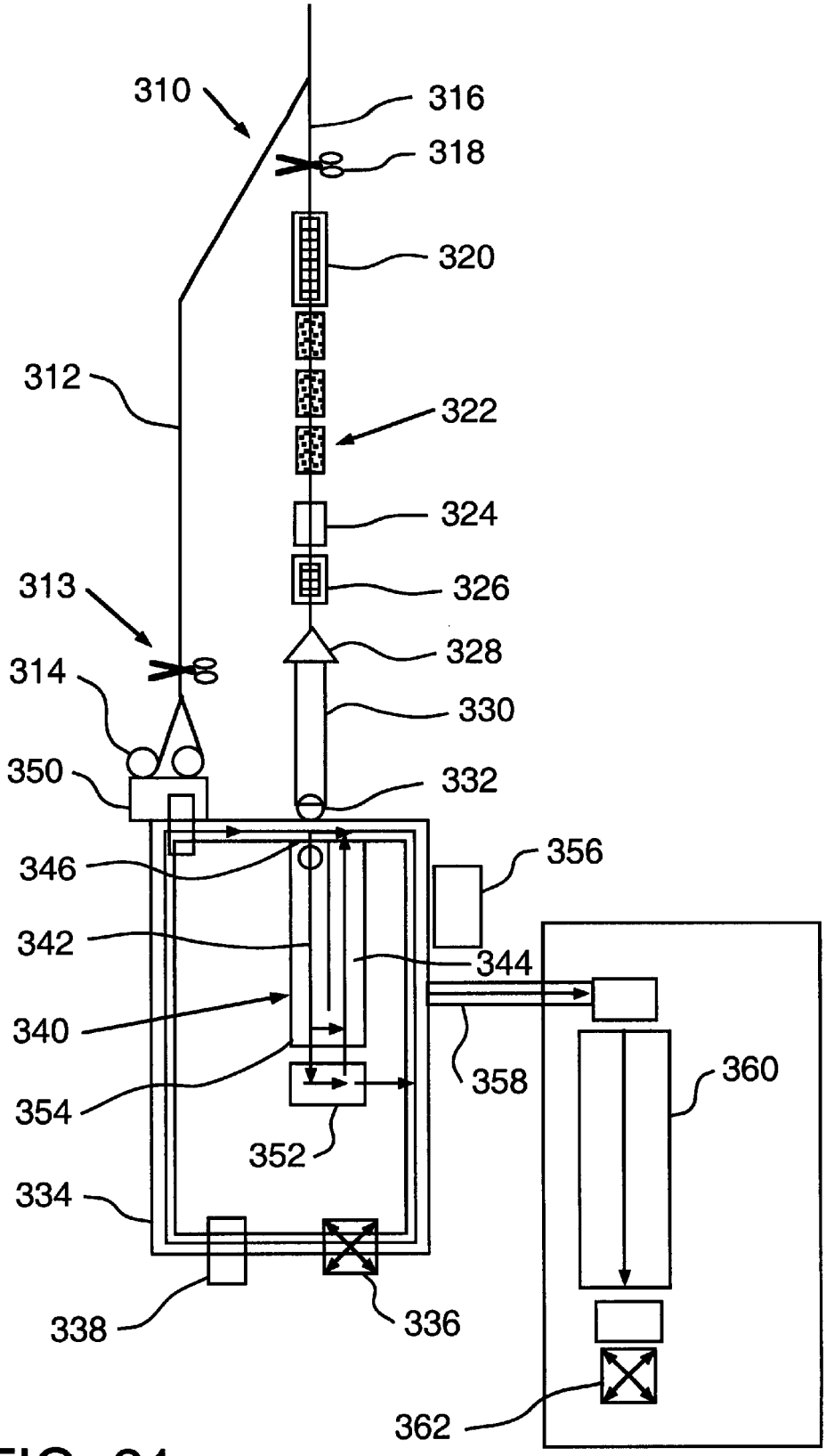
FIG. 21 is a schematic layout of the finishing area for in-line heat treatment of bars and wire rod shown in FIG. 1.

With particular reference to FIG. 21, there is shown a coil forming and heat treating facility 310 disposed in-line and downstream of the rolling mill 14 and, preferably, emanating from the mill line downstream of the reduction and sizing block 216. The location of the finishing area for in-line heat treatment of bars and wire rod, in relation to the integrated plant, is shown in FIG. 1 with the finishing area being located in D. Desirably, larger diameter rod having diameters of from about 10 to about 60 mm, which has been rolled in the rolling mill 14 and sized in the reduction and sizing block 216, is directed by well known product diverting apparatus into a Garrett line 312 of known construction in which the product is cut into pieces of predetermined length by shear 313 and then is wound into one or more coils on coilers 314. Alternatively, a second line 316 is particularly adapted for the production of smaller size products, such as wire rod having diameters between about 4 mm and about 25 mm.

As shown in the drawings, the second line 316 desirably contains, in a consecutive in-line relationship, a crop shear 318, a finishing block 320, water cooling line 322, high speed shear 324 and twin module block 326, which are all operative in the production of smaller diameter wire rod. The second line terminates in coiling apparatus including laying head 328 for forming wire rod spirals, and a roller cooling conveyor 330 along which the spirals are conducted to a coiler 332.

A ring conveyor 334 defining an essentially closed annular path is located at the ends of the respective rod producing lines 312 and 316 with the coilers 314 and 332 at the ends of the respective lines being closely spaced with respect to each other along one peripheral side of the conveyor. Other work processing stations, including an inspection and testing station 336, a coil compacting and strapping station 338 and a weighing and discharging station 340, are disposed at spaced locations about the perimeter of the conveyor 334. The ring conveyor 334, which may be of the walking beam or roller table type, permits coils to be conducted to the respective stations around the conveyor and, following discharge of the coils, permits the trestles (not shown) upon which the coils are conveyed and from which they are removed upon discharge, to be returned to positions for receiving coils from coiler 332. (Trestles are not used for coils wound on coiler 314.)

This invention contemplates the conduct of in-line heat treatments to the coils conducted by the conveyor 334. Accordingly, as shown, an elongated annealing furnace 340 is arranged to receive coils to be treated from the conveyor 334. The furnace 340 preferably has a U-shaped construction being formed of two legs 342 and 344, each of which has an end 346 and 348, respectively, opening onto the conveyor 334. Preferably, end 346, here shown as defining the inlet to the furnace 340, is located substantially directly opposite the coiler 332 whereby coils formed on the coiler can be passed directly into the furnace leg 342.

Advantageously, the furnace 340 may be heated by burners supplied from a fuel source or by induction or other electric heating means. The heat to each leg 342 or 344 of the furnace 340 is independently controlled and, if desired, only one furnace leg can be heated to the exclusion of the other leg.

Other elements which are utilized in the heat treating procedures of the described apparatus include a first quench tank 350 disposed immediately adjacent the coiler 314 of the Garrett line 312. A second quench tank 352 is disposed intermediate the ends of the furnace 340, here shown as being adjacent the nexus 354 between the two furnace legs 342 and 344.

Fans 356 are disposed adjacent one peripheral side of the conveyor 334 whereby coils carried by the conveyor can be cooled by forced air cooling.

In the disclosed arrangement a conveyor offset 358 is optionally provided for conducting coils to a cold finishing facility 360 in which the coils may undergo such processing as pickling, phosphatizing and/or lubricating, or the like. Coils, after processing in this facility are passed to a coil compacting and strapping device 362 prior to discharge from the facility.

The operation of the herein described in-line small section steel stock coiling and heat treating facility for conducting various forms of heat treatment are as follows. For workability annealing coils of stock, which stock has undergone low temperature rolling using water cooling line 322 and twin module block 326 of the second line, the coils are introduced to the annealing furnace 340 immediately after being coiled on coiler 332. The coils are held in the furnace 340 for up to about two hours and at temperatures of from about 600° C. to about 850° C. The low temperature rolling of the stock before passing it to the furnace 340 significantly reduces the length of holding time for the coils in the furnace.

For workability annealing of the rod stock conducted along the Garrett line 312, the stock undergoes low temperature rolling using controlling temperature device 212 and reduction and sizing block 216 and, after winding into coils upon coiler 314 at the end of the Garrett line, the coils are conducted along the adjacent side of the ring conveyor 334 to the annealing furnace 340 for heating under conditions similar to those previously described.

For spheroidizing annealing the rolled stock, following thermomechanical or thermocontrolled rolling within a temperature range of from about 750° C. to about 850° C., the stock is wound into coils and immediately passed to the coil annealing furnace 340 for a period of from about one to about two hours for heating at temperatures within the range of from about 680° C. to about 720° C. wherein spheroidizing occurs. After thermal treatment the coils are returned to conveyor 334 for final air cooling.

For solubilization annealing for austenitic stainless steels, the stock, which has undergone normal rolling in the rolling mill 14, is coiled by coilers 314 at the end of the Garrett line 312 at a temperature of about 900° C. and immediately passed along conveyor 330 to the coil annealing furnace 340 for heating to about 1000° C. and for the time, between about thirty and sixty minutes, to achieve solution annealing. Typically this procedure will be formed in one leg 342 of the furnace 340 whereupon the coils, after achieving solution annealing, are quenched in the quench tank 352 and thence returned to the conveyor to be conducted to a point of final processing.

For recrystallization of ferritic steels the process is similar to that performed for solubilization annealing of austenitic stainless steels, except that the coils are heated only to within the range of from about 700° C. to about 800° C. in the coil annealing furnace 340 before quenching in quench tank 352.

When quenching and tempering is to be conducted on larger diameter rod material, the stock, after undergoing conventional rolling or thermocontrolled rolling in the section including the rolling mill 210, the controlling temperature device 212 and the reduction and sizing block 216 is coiled at a temperature of about 800° C. on the coilers 314 of the Garrett line 312. Immediately after coiling, the coils are quenched in quench tank 350 to a temperature of about 100° C. Thereafter, the coils are conducted by conveyor 334 to the coil annealing furnace 340 to be heated to the tempering temperature of between about 700° C. and 500° C. for a period of one to two hours. The coils are thereafter air cooled on the conveyor 334 before being passed for further processing or to discharge.

It is contemplated that patenting of the wire rod produced on the second line 316 can be performed by thermomechanically rolling the stock at about 850° C. and thereafter subjecting it to forced air cooling by fans placed in the roller cooling conveyor 330 prior to coiling.

It should be appreciated that following all of the foregoing forms of heat treatment, the coils are returned to conveyor 334 for transport to areas of further processing, as for example via conveyor offset 358 to the cold finishing facility 360 and final packaging by the compacting and strapping device 362 prior to shipment or storage.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. Apparatus for the production of elongated rolled product comprising:

continuous casting equipment operative to produce a plurality of parallel lines of elongated product, a rolling mill positioned downstream of said continuous casting equipment in alignment with one of said lines of product, a tunnel furnace disposed intermediate said continuous casting equipment and said rolling mill along said one line of product, said tunnel furnace having a length at least equal to the length of said product and having a width effective to enclose all of said plurality of parallel lines of product, and means for sequentially transferring product within said tunnel furnace from a laterally displaced line other than said one line of product into said one line of product for delivery to said rolling mill, said tunnel furnace including a parallel roller conveyor associated with each said line of product, with each roller conveyor adapted to be independently controlled, control means for controlling the running speed of the respective conveyors in a time-variable manner.

2. Apparatus according to claim 1, including a descaling assembly included in said one line of product between said tunnel furnace and said rolling mill.

3. Apparatus according to claim 1, including an on-line conditioning device disposed in said one line of product between said tunnel furnace and said rolling mill.

4. Apparatus according to claim 1, including means disposed in each of said lines of product for dividing and cropping said product between said continuous casting equipment and said tunnel furnace.

5. Apparatus according to claim 1, including quenching boxes between said continuous casting equipment and said tunnel furnace.

6. Apparatus according to claim 1, in which said tunnel furnace includes a transfer device for transferring product laterally from the line of product laterally displaced from said one line of product onto said one line of product.

7. Apparatus according to claim 1 in which said transfer device comprises a movable beam apparatus operative to transfer product in a transverse direction within said tunnel furnace.

8. Apparatus according to claim 7 in which said transfer device operates to transfer product from the roller conveyor associated with said laterally displaced line of product onto the roller conveyor associated with said one line of product.

9. Apparatus according to claim 8 in which said conveyors are mutually separated by conductor beams utilized to provide a temporary storage of the billets.

10. Apparatus according to claim 7, including means controlling the operation of said transfer device for sequencing the conveyance of product from said laterally displaced line of product to said one line of product for maintaining a substantially continuous supply of product to said rolling mill.

11. Apparatus according to claim 1, in which said tunnel furnace is a heating and equalization furnace operative to provide said product with a predetermined rolling temperature.

12. Apparatus according to claim 1, in which said continuous casting equipment includes a pair of continuous caster machines, each being associated with a single line of product.

13. Apparatus according to claim 8, including conveying means for moving product on each of said lines of product upstream of said tunnel furnace conveyors at speeds corresponding to or greater than said rated casting speed of said product.

14. Apparatus according to claim 13, in which each said conveying means is independently controlled.

15. Apparatus according to either one of claim 13 or claim 14, wherein said conveyors within said tunnel furnace are adapted to convey products at speeds corresponding to or greater than said rated rolling speed of said product.

16. Apparatus according to claim 12 wherein the speeds of each roller conveyor are variable in time and in cooperation with the means for sequentially transferring product laterally, continuously feed the rolling mill.

17. Apparatus according to claim 16 wherein said conveying means and said transferring means is adapted such that a billet on said other line of product, after being cut, is accelerated at such a speed as to recover the time necessary for carrying out translation towards a billet on said one line of product.

18. Apparatus according to claim 15, wherein said transfer device is adapted to move product onto said one line of product conveyor to place sequential billets in closely spaced end-to-end relation when entering said rolling mill.

19. A method for in-line casting and rolling of billets from a plurality of casting lines comprising the steps of:

continuously casting a plurality of billet strands in continuous casting equipment, providing a plurality of parallelly disposed conveyors, each to receive one of said billet strands from said continuous casting equipment, providing a rolling mill in-line with one of said conveyors and not in-line with the others of said conveyors, dividing said billet strands into billets having long lengths, providing a tunnel furnace of a length at least equal to the billet lengths and a width to enclose all of said conveyors, operating said tunnel furnace to heat up and equalize the temperature of each of said billets and to place said billets at a predetermined rolling temperature, conveying said billets sequentially into said tunnel furnace, conveying billets, within said tunnel furnace, independently on each parallel disposed conveyor, controlling the running speed of the respective conveyors in a time-variable manner, providing means for transferring billets laterally from one of said other conveyors to said one conveyor, and transferring billets on one of said other conveyors to said one conveyor for discharging said billets in-line in an alternating sequence from said tunnel furnace to said rolling mill.

20. The method according to claim 19, including the step of descaling said billets intermediate said tunnel furnace and said rolling mill.

21. The method according to claim 19, including the step of conditioning said billets in said one line of product between said tunnel furnace and said rolling mill.

22. The method according to claim 19, including the step of quenching said billets in at least one of said lines between said continuous casting equipment and said tunnel furnace.

23. The method according to claim 19, including the steps of:

moving said billets on said conveyors at speeds corresponding to or greater than said rated casting speed from the point of dividing the billet strand to the entrance of said tunnel furnace, and moving said billets within said tunnel furnace and thereafter at substantially no less than the rated rolling speed of said rolling mill.

24. The method according to claim 23, including the step of moving said billets on said one conveyor to place said billets in closely spaced end-to-end disposition thereon and provide the ends of succeeding billets in substantially contiguous relation when delivered to said rolling mill.

25. The method according to claim 19, wherein the speeds of each roller conveyor are variable in time such as to provide, in cooperation with the means for transferring billets laterally, continuous feeding of the rolling mill.

26. The method according to claim 19, wherein a billet on another line of product, after being cut, is accelerated at such a speed as to recover the time necessary for carrying out translation towards a billet on said one line of product.

27. Apparatus for the production of elongated rolled product comprising:

continuous casting equipment operative to produce a plurality of parallel lines of elongated product, a rolling mill having a plurality of mill stands positioned downstream of said continuous casting equipment in alignment with one of said lines of product, a tunnel furnace disposed intermediate said continuous casting equipment and said rolling mill along said one line of product, said tunnel furnace having a length at least equal to the length of said product and having a width effective to enclose all of said plurality of parallel lines of product, means for sequentially transferring product within said tunnel furnace from a line other than said one line of product into said one line of product for delivery to said rolling mill, said tunnel furnace including a parallel roller conveyor associate with each said line of product, with each roller conveyor adapted to be independently controlled, control means for controlling the running speed of the respective conveyors in a time-variable manner, a stand storage area adjacent and parallel to said rolling mill, said stand storage area including a plurality of stand storage compartments disposed in end-to-end relation along a line parallel to said rolling mill, a quick change table extending parallel to said rolling mill intermediate said rolling mill and said stand storage area, said quick change table being movable in opposite linear directions parallel to said rolling mill and said stand storage area, means for transferring mill stands between said stand storage area and said quick change table including a way disposed between said quick change table and said stand storage area and controllable mobile transfer devices movable along said way and operative for transferring mill stands delivered to said quick change table to said stand storage area, means disposed in-line with said rolling mill for heat treating elongated metal stock from said rolling mill including a quenching box for controllably cooling hot rolled stock for quenching purposes, induction heating means for heating up and equalizing the rolled or rolled and quenched stock, an annealing furnace for annealing or tempering said stock, a cooling bed disposed upstream of said annealing furnace for controllably cooling the stock, and including means for selectively directing stock along alternate selected flow paths, and apparatus disposed in-line with said rolling mill for finishing hot rolled stock therefrom, said apparatus including a conveyor having a closed path, a coil heating chamber disposed interiorly of said path and having an inlet opening and an outlet opening communicating with said conveyor path, coiling means adjacent said conveyor for winding said stock into coils, means for transferring wound coils to said conveyor, means for moving said wound coils about said conveyor path including movement selectively through said coil heating chamber, means upstream of said coiling means for finishing said stock including a first rod finishing line for rolling a billet to a wire rod size, a second rod finishing line consisting of a Garrett line, and means for delivering stock from said rolling mill to one of said rod finishing lines.

28. Apparatus according to claim 1, wherein each independently controlled roller conveyor associated with each line of product is independently controlled along the conveyor length to enable end to end positioning of product entering said rolling mill.

* * * * *